US011834841B2

(12) United States Patent
MacPherson

(10) Patent No.: US 11,834,841 B2
(45) Date of Patent: Dec. 5, 2023

(54) CLADDING ELEMENT

(71) Applicant: James Hardie Technology Limited, Dublin (IE)

(72) Inventor: Thomas Edward MacPherson, Rancho Cucamonga, CA (US)

(73) Assignee: James Hardie Technology Limited, Dublin (IE)

( * ) Notice: Subject to any disclaimer, the term of this patent is extended or adjusted under 35 U.S.C. 154(b) by 248 days.

(21) Appl. No.: 17/643,930

(22) Filed: Dec. 13, 2021

(65) Prior Publication Data

US 2022/0098876 A1 Mar. 31, 2022

Related U.S. Application Data

(63) Continuation of application No. PCT/EP2020/068313, filed on Jun. 29, 2020.

(60) Provisional application No. 62/943,738, filed on Dec. 4, 2019, provisional application No. 62/868,379, filed on Jun. 28, 2019.

(51) Int. Cl.

| | |
|---|---|
| ***E04F 13/08*** | (2006.01) |
| ***E04F 13/14*** | (2006.01) |
| ***E04F 13/16*** | (2006.01) |

(52) U.S. Cl.

CPC ..... *E04F 13/0894* (2013.01); *E04F 13/0864* (2013.01); *E04F 13/14* (2013.01); *E04F 13/16* (2013.01); *E04F 2201/026* (2013.01)

(58) Field of Classification Search

CPC ... E04F 13/0894; E04F 13/0864; E04F 13/14; E04F 13/16; E04F 2201/026

USPC ..... 52/442

See application file for complete search history.

(56) References Cited

U.S. PATENT DOCUMENTS

| | | | |
|---|---|---|---|
| 294,855 | A | 3/1884 | Crawford |
| 467,063 | A | 1/1892 | Sword |
| 525,442 | A | 9/1894 | Burrows |
| 2,110,729 | A | 3/1938 | Hoggatt |
| 4,261,152 | A | 4/1981 | Tellman |

(Continued)

FOREIGN PATENT DOCUMENTS

| | | |
|---|---|---|
| CA | 1122379 A | 4/1982 |
| DE | 3532112 | 3/1987 |

(Continued)

OTHER PUBLICATIONS

Boral TruExterior Siding and Trim, http://www.boralamerica.com/TruExterior/truexterior-siding as printed Nov. 25, 2015 in 2 pages.

(Continued)

*Primary Examiner* — Mark R Wendell

(74) *Attorney, Agent, or Firm* — Knobbe, Martens, Olson & Bear LLP

(57) ABSTRACT

A cladding element, for use in a building envelope, comprising a first face, a second face and a plurality of edges. One or more of the plurality of edges includes a mating feature configured to resist moisture passage between cladding elements when the cladding elements are installed on a wall or other structure. The mating features of each cladding element including one or more concave arcuate bevelled edges designed to improve the overall aesthetic appearance of the mating interface between adjacent cladding elements when installed on a wall or other structure.

24 Claims, 19 Drawing Sheets

(56) References Cited

U.S. PATENT DOCUMENTS

| | | | | |
|---|---|---|---|---|
| 4,774,794 | A | 10/1988 | Grieb | |
| 4,955,169 | A | 9/1990 | Shisko | |
| 5,016,416 | A * | 5/1991 | Munk | B27N 5/00 428/218 |
| 8,484,931 | B2 * | 7/2013 | Gleeson | E04F 19/022 52/489.1 |
| 8,733,410 | B2 | 5/2014 | Pervan | |
| D729,949 | S | 5/2015 | Hartman | |
| 9,140,018 | B2 | 9/2015 | Southwell | |
| 9,752,328 | B2 * | 9/2017 | Everhart, II | E04F 13/0894 |
| 10,240,348 | B2 | 3/2019 | Pervan et al. | |
| 10,458,124 | B2 | 10/2019 | Arne et al. | |
| 10,519,673 | B2 | 12/2019 | Joshi et al. | |
| 2003/0046888 | A1 | 3/2003 | Ryan | |
| 2003/0046891 | A1 | 3/2003 | Colada et al. | |
| 2004/0206036 | A1 | 10/2004 | Pervan | |
| 2004/0231252 | A1 | 11/2004 | Benjamin | |
| 2005/0247022 | A1 | 11/2005 | Poupart | |
| 2006/0174575 | A1 | 8/2006 | Woods | |
| 2006/0185299 | A1 | 8/2006 | Poupart | |
| 2008/0196354 | A1 | 8/2008 | Attebery | |
| 2009/0007516 | A1 * | 1/2009 | Swanson | E04F 13/0864 52/524 |
| 2010/0170182 | A1 | 7/2010 | Gately | |
| 2011/0167744 | A1 | 7/2011 | Whispell et al. | |
| 2011/0167750 | A1 | 7/2011 | Pervan | |
| 2012/0317909 | A1 | 12/2012 | Mackenzie | |
| 2013/0283720 | A1 | 10/2013 | Pervan et al. | |
| 2013/0312356 | A1 | 11/2013 | Foral | |
| 2014/0215945 | A1 * | 8/2014 | Swanson | E04F 13/0894 52/302.1 |
| 2014/0345226 | A1 | 11/2014 | Southwell | |
| 2019/0330856 | A1 | 10/2019 | MacPherson et al. | |

FOREIGN PATENT DOCUMENTS

| | | | |
|---|---|---|---|
| DE | 102015111930 | A1 | 1/2017 |
| WO | WO 2004/081316 | | 9/2004 |
| WO | WO 2005/098163 | | 10/2005 |
| WO | WO 2010/065987 | A1 | 6/2010 |
| WO | WO 2020/260721 | | 12/2020 |

OTHER PUBLICATIONS

Ready Pine Refinished Interior Tongue & Groove by Horizon Coatings, "The Original," http://www.readypine.com/About.htm, as printed Mar. 11, 2015 in 3 pages.

Vintage Woodworks, "V-Groove Board," http://www.vintagewoodworks.com/v-groove.html as printed Mar. 11, 2015 in 2 pages.

International Search Report for International Application No. PCT/EP2020/068313 dated Sep. 24, 2020.

* cited by examiner

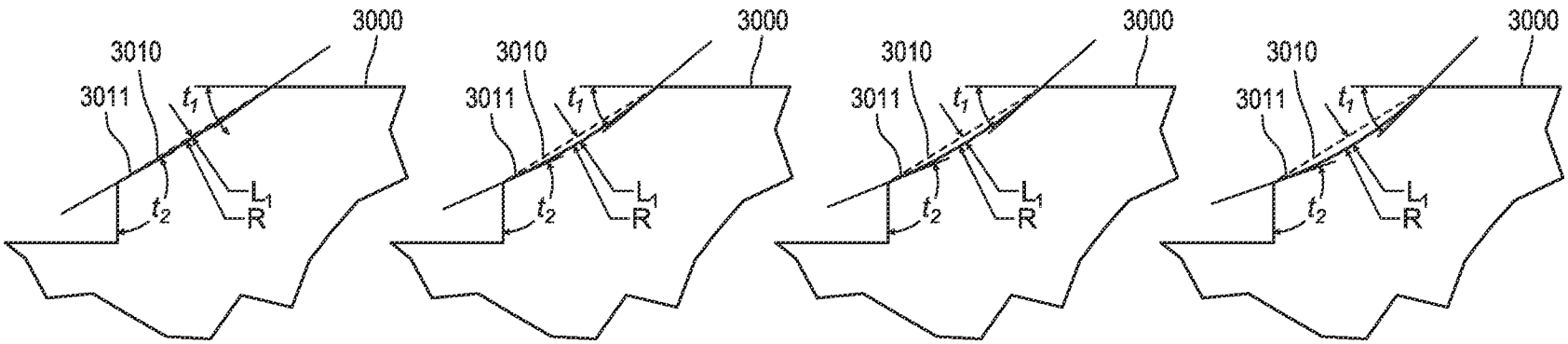
FIG. 7A
FIG. 7B
FIG. 7C
FIG. 7D
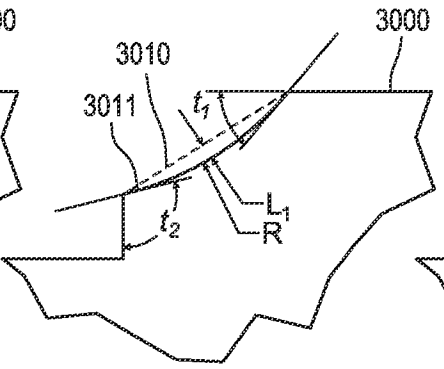
FIG. 7E
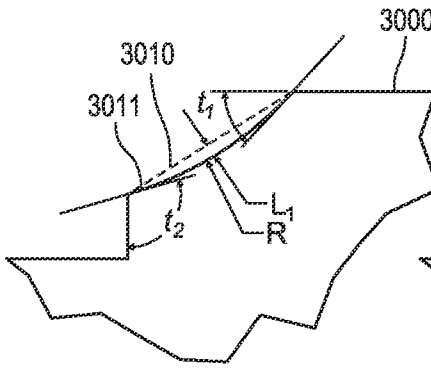
FIG. 7F
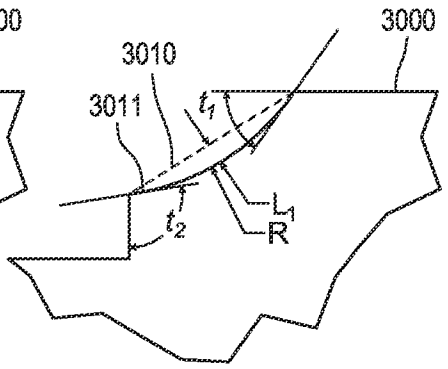
FIG. 7G

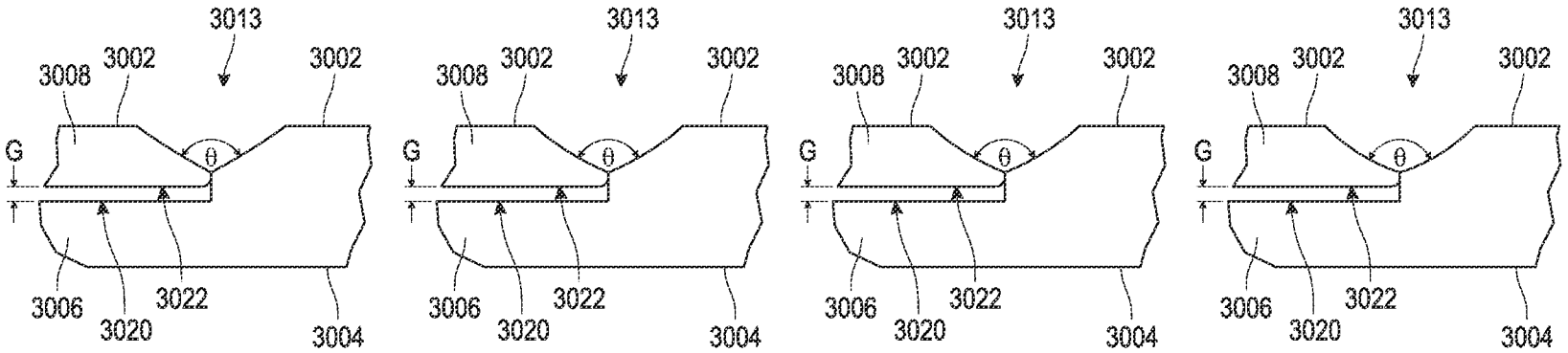
FIG. 8A
FIG. 8B
FIG. 8C
FIG. 8D
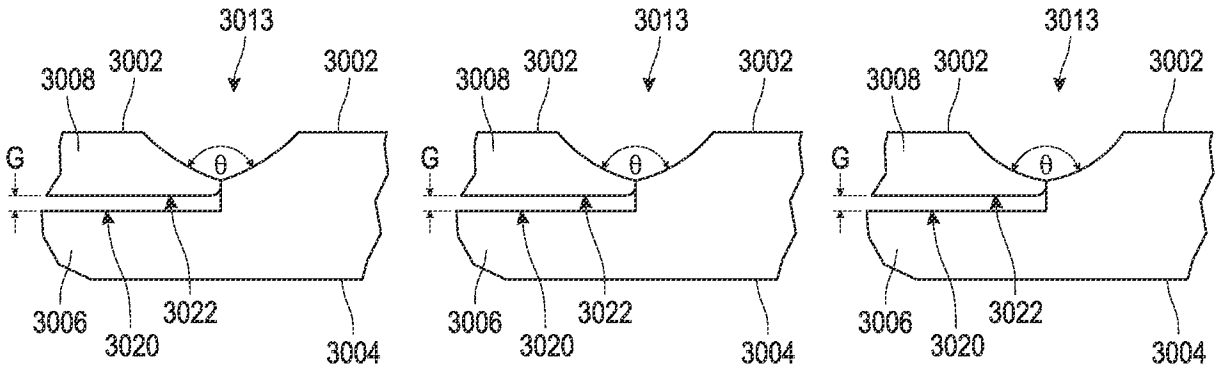
FIG. 8E
FIG. 8F
FIG. 8G

CLADDING ELEMENT

CROSS-REFERENCE TO RELATED APPLICATIONS

This application is a continuation of PCT International Application No. PCT/EP2020/068313, filed Jun. 29, 2020 entitled 'Cladding Element', which claims the benefit of U.S. Provisional Application Ser. No. 62/868,379, filed Jun. 28, 2019 entitled 'Cladding Element' and U.S. Provisional Application Ser. No. 62/943,738, filed Dec. 4, 2019 entitled 'Cladding Element'. All of the applications listed above are hereby incorporated by reference in their entirety and for all purposes.

FIELD

The present disclosure generally relates to cladding elements suitable for use in building construction, in particular, cladding elements suitable for use in a building envelope.

The embodiments have been developed primarily for use as cladding elements and will be described hereinafter with reference to this application. However, it will be appreciated that the embodiments are not limited to this particular field of use and that the embodiments can be used in any suitable field of use known to the person skilled in the art.

BACKGROUND

Any discussion of the prior art throughout the specification should in no way be considered as an admission that such prior art is widely known of forms part of the common general knowledge in the field.

Cladding elements are used to protect and/or improve the aesthetic qualities of building walls and other structures. Cladding elements come in many forms, for example plank, panel, shingle and so forth. Such cladding elements comprise timber or non-timber materials, wherein the non-timber materials include for example, fibre cement. Plank cladding elements are provided in varying thicknesses as dictated by the material of the cladding element. For example, timber plank cladding elements typically range in thickness from 18 to 22 mm or greater whilst fibre cement plank or panel cladding elements are generally thinner than this typical thickness range for timber plank cladding elements.

There are a number of different methods used to install cladding elements in series on a building substrate, each method dependent on the type of cladding material used, the wind load requirements and the desired aesthetic effect.

There are also a number of options for aesthetics at the interface between two adjacent cladding elements in a series. The interface between two adjacent cladding elements are commonly profiled to have either a 'v' groove channel, a square channel or a rabbet profile. The rabbet profile was developed by the wood industry and is more commonly referred to as ship-lap. The rabbet profile appears as a step shaped recess or rebate between the two adjacent cladding elements.

There are substantially two main methods used when installing plank cladding elements namely lap side cladding or flat wall cladding.

Lap side cladding is used to describe cladding elements that are installed on a structural support such that there is an overlap between consecutive cladding elements, whereby the primary visible external surfaces of consecutive cladding elements are parallel but not coplanar.

In contrast, flat wall cladding is used to describe cladding elements that are installed on a structural support such that there is no overlap between consecutive cladding elements, whereby the primary visible external surfaces of consecutive cladding elements are parallel and coplanar.

There are a number of different installation methods used to achieve a flat wall cladding aesthetic, for example, stacking rabbet/ship-lap, tongue and groove, and clip. In each of the stacking rabbet/ship-lap and tongue and groove installation methods, the cladding elements are profiled such that the bottom edge of a first cladding element is able to overlap the top edge of a second cladding element when the second cladding element is positioned below the first cladding element whilst ensuring that the primary visible external surfaces of consecutive first and second cladding elements are parallel and coplanar. Typically, fibre cement cladding elements used in either the stacking rabbet/ship-lap and tongue and groove installation methods are approximately 16 mm thick. The thickness and configuration of the cladding elements enable a cladding system using said cladding elements and standard nailing methods to achieve a desired wind load requirement.

The clip installation method can take a number of forms but is characterized by a common or specialized fastener (clip) that engages the cladding elements positioned both above and below the fastener. The primary benefits of using a specialized fastener/clip to secure consecutive cladding elements is that clip can spread fastening load over a greater area than for example a traditional nail fastener. Typically, fibre cement cladding elements used in the clip installation method are approximately 12 mm thick. A clip installation method enables an installer to clad a building wall or other structure with thinner cladding elements and achieve a flat wall aesthetic that has similar and possibly better wind load performance over cladding elements installed without the specialized fastener.

A thinner board is typically lighter than an equivalent 16 mm board. Accordingly, it is easier for an end user to handle this board. It is therefore desirable to provide a fibre cement cladding element that is as thin as or thinner than fibre cement cladding elements typically used in clip installation methods, that can be installed in a cladding system without a clip or specialized fastener whilst achieving the same or better wind loading.

Cladding elements can be assembled to produce cladding systems (e.g., wall portions). These cladding systems can be installed on an exterior or interior surface of a wall to provide aesthetic improvement, improved weather resistance, improved thermal efficiency, improved structural stability, and/or many other improvements to an existing wall. For example, the cladding systems disclosed herein can be installed on substructure such as a wooden frame or any other suitable wall structure which could be an interior or exterior wall structure.

SUMMARY OF THE INVENTION

Generally described, the present disclosure provides for cladding elements that provide a desirable aesthetic appearance and retain suitable wind load resistance characteristics such that the cladding elements can be installed without the need for a clip mechanism. In one example, the cladding elements of the present disclosure have a v-groove aesthetic including one or more chamfered or bevelled edges along a front face. In a further example, the cladding elements can have other types of chamfered or bevelled aesthetics characterised in that the aesthetic comprises at least one or more chamfered or bevelled edge along a front face. The cladding element of the present disclosure has a relatively shallow chamfer angle. However, a shallow chamfer angle may result in undesirably large variation in the apparent width of the chamfer or bevel, caused by relatively minor variations in the thickness of the cladding elements.

Accordingly, the present disclosure provides a concave arcuate bevelled surface profile rather than a straight chamfer angle in a chamfered or bevelled aesthetics such as a v-groove aesthetic. The concave arcuate bevelled surface may be described by at least a tangential angle formed at the interface between the concave arcuate bevelled surface and the front face of the cladding element, and a radius of curvature of the concave arcuate bevelled surface. As will be described in greater detail, the concave arcuate bevelled surface described herein may improve the aesthetic appearance of the cladding elements by retaining the full width of the chamfer or bevel of straight chamfered cladding elements by increasing the tangential angle between the chamfer and the front face of the cladding element, thus reducing the apparent variation in v-groove thickness to a visually imperceptible level.

According to the present disclosure there is provided a cladding element as set out in appended claims 1 to 16 and a cladding element with a v-groove interlocking profile as set out in appended claims 17 to 26. There is also provided a wall cladding system comprising at least one cladding element as set out in appended claims 27 to 51.

Accordingly, there is provided in various embodiments a cladding element comprising

- a front face;
- a rear face opposite the front face;
- opposing first and second contoured side profiles between the front face and the rear face;
- the first contoured side profile comprising;
  - a first concave arcuate bevelled surface extending from the front face of the cladding element toward a first recessed portion having a front-facing surface set rearward from the front surface of the cladding element; and
  - a first end connecting the front-facing surface of the first recessed portion with the rear face;
- the second contoured side profile comprising;
  - a second concave arcuate bevelled surface extending from the front face of the cladding element toward a second recessed portion having a rear-facing surface set forward from the rear face of the cladding element; and
- a second end connecting the rear-facing surface of the second recessed portion with the rear face.

In a further embodiment, the cladding element further comprises one or more chamfered profiles in the front face wherein each chamfered profile comprises first and second concave arcuate bevelled surfaces. In practice, the first and second concave arcuate bevelled surfaces are spaced apart from each other at a first chamfered profile end adjacent the front face of the cladding element and taper to join at a second chamfered profile end at an opposing end remote the front face of the cladding element. In another embodiment, the first and second concave arcuate bevelled surfaces further comprise a base member intermediate the second profiled ends of the first and second concave arcuate bevelled surfaces such that a truncated chamfered profile is formed in the front face of the cladding element. In an alternative embodiment, the cladding element comprises a combination of one or more chamfered profiles and tapered chamfered profiles. In such embodiments, the chamfered and/or tapered chamfered profiles are spaced apart from each other on the front face of the cladding element as desired. In one example, the chamfered and/or tapered chamfered profiles are spaced apart from each other by approximately 30.4 cm (12").

In one embodiment, the first and second concave arcuate bevelled surface intersects the front face at a first angle t1 relative to the front face.

In one embodiment, the first angle t1 between approximately 32° and approximately 90°.

In one embodiment, the first angle t1 between approximately 40° and approximately 80°.

In one embodiment, the first angle t1 between approximately 38° and approximately 42°.

In one embodiment, the first angle t1 approximately 39.6°.

In one embodiment, the first concave arcuate bevelled surface has a radius of curvature between approximately 67.61 mm and approximately 4.84 mm.

In one embodiment, the first concave arcuate bevelled surface has a radius of curvature between approximately 26.30 mm and approximately 13.84 mm.

In one embodiment, the first concave arcuate bevelled surface and the second concave arcuate bevelled surface intersect the front face at approximately the same tangential angle.

In one embodiment, the first concave arcuate bevelled surface and the second concave arcuate bevelled surface have approximately the same radius of curvature.

In one embodiment, the cladding element comprises fibre cement.

In one embodiment, the cladding element has a thickness between approximately 7 mm and approximately 17 mm.

In a third embodiment, a cladding element comprises: a front face; a rear face opposite the front face; a first contoured side profile between the front face and the rear face; a second contoured side profile between the front face and the rear face, opposite the first contoured side profile. The first contoured side profile comprises: a first recessed portion having a front-facing surface set rearward from the front surface of the cladding element; a first chamfer portion extending from the rear face of the cladding element toward the front face of the cladding element and away from a second contoured side profile of the cladding element; a first concave arcuate bevelled surface extending from the front face of the cladding element toward the first recessed portion and away from the second contoured side profile; and a first abutment face connecting the front-facing surface of the first recessed portion with the first concave arcuate bevelled surface. The second contoured side profile comprises: a second recessed portion having a rear-facing surface set forward from the rear face of the cladding element; a second chamfer portion extending in a direction from the rear face of the cladding element toward the front face of the cladding element and toward the first contoured side profile; a second concave arcuate bevelled surface extending from the front face of the cladding element toward the recessed portion and away from the first contoured side profile; and a second abutment face connecting the rear-facing surface of the recessed portion with the concave arcuate bevelled surface.

In a further embodiment, the cladding element of the third embodiment, optionally further comprises one or more chamfered profiles in the front face wherein each chamfered profile comprises first and second concave arcuate bevelled surfaces. In practice, the first and second concave arcuate bevelled surfaces are spaced apart from each other at a first chamfered profile end adjacent the front face of the cladding element and taper to join at a second chamfered profile end at an opposing end remote the front face of the cladding element. In another embodiment, the first and second concave arcuate bevelled surfaces further comprise a base member intermediate the second profiled ends of the first and second concave arcuate bevelled surfaces such that a truncated chamfered profile is formed in the front face of the cladding element. In an alternative embodiment, the cladding element comprises a combination of one or more chamfered profiles and tapered chamfered profiles. In such embodiments, the chamfered and/or tapered chamfered profiles are spaced apart from each other on the front face of the cladding element as desired. In one example, the chamfered and/or tapered chamfered profiles are spaced apart from each other by approximately 30.4 cm (12").

In one embodiment, the first concave arcuate bevelled surface intersects the front face at a first angle t1 relative to the front face and intersects the first abutment face at a second angle smaller than t1 relative to a plane parallel to the front face.

In one embodiment, the first angle t1 is between approximately 32° and approximately 47.5°.

In one embodiment, the first angle t1 is between approximately 40° and approximately 47.5°.

In one embodiment, the first angle t1 is between approximately 38° and approximately 42°.

In one embodiment, the first angle t1 is approximately 39.6°.

In one embodiment, the first concave arcuate bevelled surface has a radius of curvature between approximately 67.61 mm and approximately 13.84 mm.

In one embodiment, the first concave arcuate bevelled surface has a radius of curvature between approximately 26.30 mm and approximately 13.84 mm.

In one embodiment, the first concave arcuate bevelled surface and the second concave arcuate bevelled surface intersect the front face at approximately the same tangential angle.

In one embodiment, the first concave arcuate bevelled surface and the second concave arcuate bevelled surface have approximately the same radius of curvature.

In one embodiment, the cladding element comprises fibre cement.

In one embodiment, the cladding element has a thickness between approximately 7 mm and approximately 17 mm.

In a further embodiment, a cladding system comprises a plurality of cladding elements is described. The system comprises: a first cladding element having a front face and a first contoured side profile comprising a first concave arcuate bevelled surface intersecting the front face of the first cladding element along a first edge of the front face of the first cladding element; and a second cladding element having a front face and a second contoured side profile comprising a second concave arcuate bevelled surface intersecting the front face of the second cladding element along a second edge of the front face of the second cladding element. The first concave arcuate bevelled surface and the second concave arcuate bevelled surface together form an arcuate v-groove extending along a length of the first and second cladding elements between the front face of the first cladding element and the front face of the second cladding element.

In one embodiment, the first concave arcuate bevelled surface intersects the front face of the first cladding element at a first angle t1 relative to the front face of the first cladding element, and the second concave arcuate bevelled surface intersects the front face of the second cladding element at the first angle t1.

In one embodiment, the first angle t1 is between approximately 32° and approximately 47.5°.

In one embodiment, the first angle t1 is between approximately 40° and approximately 47.5°.

In one embodiment, the first angle t1 is between approximately 38° and approximately 42°.

In one embodiment, the first angle t1 is approximately 39.6°.

In one embodiment, the first concave arcuate bevelled surface has a radius of curvature between approximately 67.61 mm and approximately 13.84 mm.

In one embodiment, the first concave arcuate bevelled surface has a radius of curvature between approximately 26.30 mm and approximately 13.84 mm.

In one embodiment, the first and second cladding elements have a thickness of between approximately 11 mm and approximately 17 mm.

In one embodiment, the arcuate v-groove extends along the entire length of each of the first and second cladding elements with no visibly perceptible variations in a width of the v-groove.

In one embodiment, the first and second cladding elements comprise fibre cement.

In one embodiment, the first and second cladding elements have a thickness between approximately 7 mm and approximately 17 mm.

In another embodiment, a cladding system comprising a plurality of cladding elements is described. The system comprises first and second cladding elements, each of the first and second cladding elements having: a front face; a rear face opposite the front face; a first contoured side profile between the front face and the rear face, a second contoured side profile between the front face and the rear face opposite the first contoured side profile; a first joint end between the front face and the rear face; and a second joint end between the front face and the rear face, opposite the first joint end. The first contoured side profile comprises: a first recessed portion having a front-facing surface set rearward from the front surface of the cladding element; a first chamfer portion extending from the rear face of the cladding element toward the front face of the cladding element and away from a second contoured side profile of the cladding element; a first concave arcuate bevelled surface extending from the front face of the cladding element toward the first recessed portion and away from the second contoured side profile; and a first abutment face connecting the front-facing surface of the first recessed portion with the first concave arcuate bevelled surface. The second contoured side profile comprises: a second recessed portion having a rear-facing surface set forward from the rear face of the cladding element; a second chamfer portion extending in a direction from the rear face of the cladding element toward the front face of the cladding element and toward the first contoured side profile; a second concave arcuate bevelled surface extending from the front face of the cladding element toward the recessed portion and away from the first contoured side profile; and a second abutment face connecting the rear-facing surface of the recessed portion with the concave arcuate bevelled surface. The first contoured side profile of the first cladding element is mated with the second contoured side profile of the second cladding element. At least a portion of the first chamfer portion of the first cladding element contacts at least a portion of the second chamfer portion of the second cladding element. The first concave arcuate bevelled surface of the first cladding element is positioned adjacent the second concave arcuate bevelled surface of the second cladding element to form an arcuate v-groove profile.

In one embodiment, the first concave arcuate bevelled surface intersects the front face at a first angle t1 relative to the front face and intersects the first abutment face at a second angle smaller than t1 relative to a plane parallel to the front face.

In one embodiment, the first angle t1 is between approximately 32° and approximately 47.5°.

In one embodiment, the first angle t1 is between approximately 40° and approximately 47.5°.

In one embodiment, the first angle t1 is between approximately 38° and approximately 42°.

In one embodiment, the first angle t1 is approximately 39.6°.

In one embodiment, the first concave arcuate bevelled surface has a radius of curvature between approximately 67.61 mm and approximately 13.84 mm.

In one embodiment, the first concave arcuate bevelled surface has a radius of curvature between approximately 26.30 mm and approximately 13.84 mm.

In one embodiment, the first concave arcuate bevelled surface and the second concave arcuate bevelled surface intersect the front face at approximately the same tangential angle.

In one embodiment, the first concave arcuate bevelled surface and the second concave arcuate bevelled surface have approximately the same radius of curvature.

In one embodiment, the arcuate v-groove profile extends along an entire length of each of the first and second cladding elements with no visibly perceptible variations in a width of the v-groove profile.

In one embodiment, the first and second cladding elements comprise fibre cement.

In one embodiment, the cladding element has a thickness between approximately 7 mm and approximately 17 mm.

In a further embodiment, the cladding elements of the cladding systems of the present disclosure, optionally further comprise one or more chamfered profiles in the front face wherein each chamfered profile comprises first and second concave arcuate bevelled surfaces. In practice, the first and second concave arcuate bevelled surfaces are spaced apart from each other at a first chamfered profile end adjacent the front face of the cladding element and taper to join at a second chamfered profile end at an opposing end remote the front face of the cladding element. In another embodiment, the first and second concave arcuate bevelled surfaces further comprise a base member intermediate the second profiled ends of the first and second concave arcuate bevelled surfaces such that a truncated chamfered profile is formed in the front face of the cladding element. In an alternative embodiment, the cladding element comprises a combination of one or more chamfered profiles and tapered chamfered profiles. In such embodiments, the chamfered and/or tapered chamfered profiles are spaced apart from each other on the front face of the cladding element as desired. In one example, the chamfered and/or tapered chamfered profiles are spaced apart from each other by approximately 30.4 cm (12").

For the purposes of this specification, the term 'comprise' shall have an inclusive meaning. Thus, it is understood that it should be taken to mean an inclusion of not only the listed components it directly references, but also non specified components. Accordingly, the term 'comprise' is to be attributable with as broad an interpretation as possible and this rationale should also be used when the terms 'comprised' and/or 'comprising' are used.

BRIEF DESCRIPTION OF THE DRAWINGS

The embodiments will now be described more particularly with reference to the accompanying drawings, which show by way of example only cladding elements of the disclosure.

FIGS. 7A to 7G are enlarged cross-sectional side views of further embodiments of the bevel area of a cladding element;

FIGS. 8A to 8G are enlarged cross-sectional side views of the further embodiments of the bevel area of FIGS. 7A to 7G, wherein two cladding elements are in an abutment arrangement;

DETAILED DESCRIPTION OF THE PREFERRED EMBODIMENTS

Figure 1:
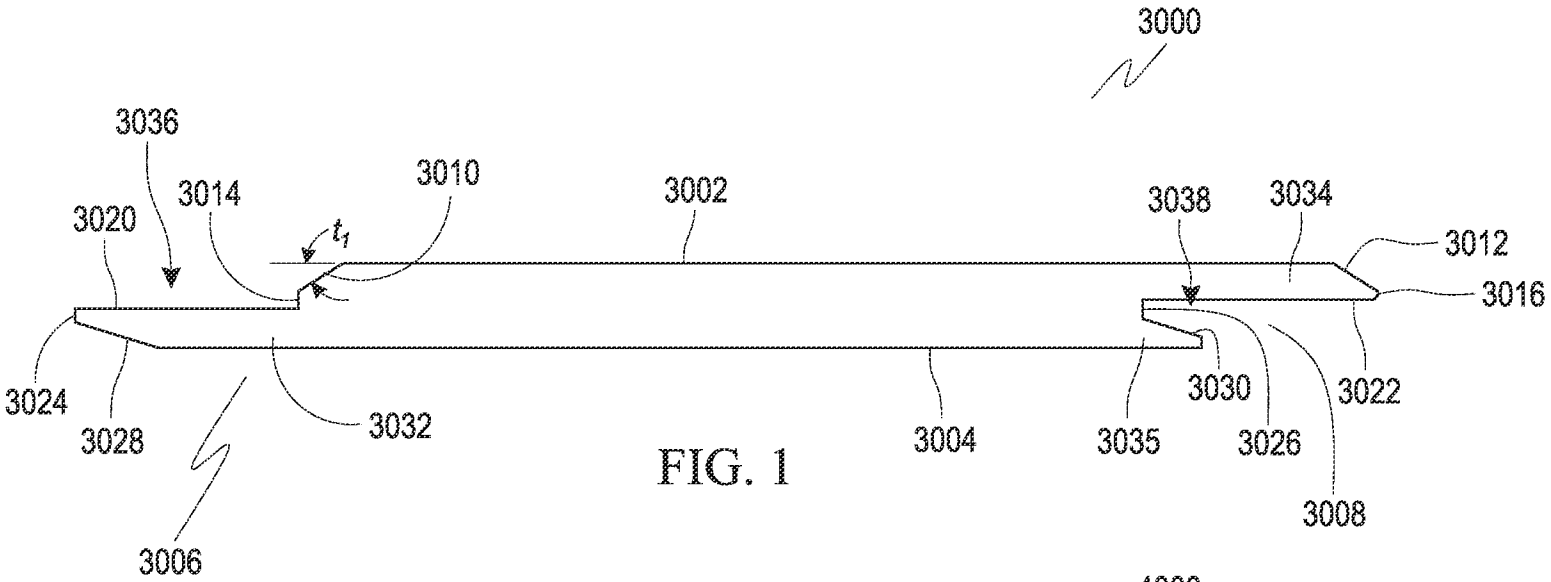
FIG. 1 is a cross-sectional side view of one embodiment of a cladding element.

Although making and using various embodiments are discussed in detail below, it should be appreciated that the embodiments described provide inventive concepts that may be embodied in a variety of contexts. The embodiments discussed herein are merely illustrative of ways to make and use the disclosed devices, systems and methods and do not limit the scope of the disclosure.

In the description which follow, like parts may be marked throughout the specification and drawings with the same reference numerals. The drawing figures are not necessarily to scale and certain features may be shown exaggerated in scale or in somewhat generalized or schematic form in the interest of clarity and conciseness.

A number of different methods used to install cladding elements in series on a building substrate are known, each method dependent on the type of cladding material used, the wind load requirements and the desired aesthetic effect.

There are also a number of options for aesthetics at the interface between two adjacent cladding elements in a series. The interface between two adjacent cladding elements are commonly profiled to have either a 'v' groove channel, a square channel or a rabbet profile. The rabbet profile was developed by the wood industry and is more commonly referred to as ship-lap. The rabbet profile appears as a step shaped recess or rebate between the two adjacent cladding elements.

There are substantially two main methods used when installing plank cladding elements namely lap side cladding or flat wall cladding.

Lap side cladding is used to describe cladding elements that are installed on a structural support such that there is an overlap between consecutive cladding elements, whereby the primary visible external surfaces of consecutive cladding elements are parallel but not coplanar.

In contrast, flat wall cladding is used to describe cladding elements that are installed on a structural support such that there is no overlap between consecutive cladding elements, whereby the primary visible external surfaces of consecutive cladding elements are parallel and coplanar.

There are a number of different installation methods used to achieve a flat wall cladding aesthetic, for example, stacking rabbet/ship-lap, tongue and groove, and clip. In each of the stacking rabbet/ship-lap and tongue and groove installation methods, the cladding elements are profiled such that the bottom edge of a first cladding element is able to overlap the top edge of a second cladding element when the second cladding element is positioned below the first cladding element whilst ensuring that the primary visible external surfaces of consecutive first and second cladding elements are parallel and coplanar. Typically, fibre cement cladding elements used in either the stacking rabbet/ship-lap and tongue and groove installation methods are approximately 16 mm thick. The thickness and configuration of the cladding elements enable a cladding system using said cladding elements and standard nailing methods to achieve a desired wind load requirement.

The clip installation method can take a number of forms but is characterized by a common or specialized fastener (clip) that engages the cladding elements positioned both above and below the fastener. The primary benefits of using a specialized fastener/clip to secure consecutive cladding elements is that clip can spread fastening load over a greater area than for example a traditional nail fastener. Typically, fibre cement cladding elements used in the clip installation method are approximately 12 mm thick. A clip installation method enables an installer to clad a building wall or other structure with thinner cladding elements and achieve a flat wall aesthetic that has similar and possibly better wind load performance over cladding elements installed without the specialized fastener.

A thinner board is typically lighter than an equivalent 16 mm board. Accordingly, it is easier for an end user to handle this board. It is therefore desirable to provide a fibre cement cladding element that is as thin as or thinner than fibre cement cladding elements typically used in clip installation methods, that can be installed in a cladding system without a clip or specialized fastener whilst achieving the same or better wind loading.

Cladding elements can be assembled to produce cladding systems (e.g., wall portions). These cladding systems can be installed on an exterior or interior surface of a wall to provide aesthetic improvement, improved weather resistance, improved thermal efficiency, improved structural stability, and/or many other improvements to an existing wall. For example, the cladding systems disclosed herein can be installed on substructure such as a wooden frame or any other suitable wall structure which could be an interior or exterior wall structure.

Generally described, the present disclosure provides for relatively thin cladding elements that provide a desirable aesthetic appearance and retain suitable wind load resistance characteristics. In one example, cladding elements having one or more chamfered or bevelled edges along a front face, for example, in the form of a v-groove design. When the cladding elements are made relatively thin, a relatively shallow chamfer angle may be needed to retain sufficient strength and/or wind load characteristics. However, the shallow chamfer angle may result in undesirably large variation in the apparent width of the v-groove formed by adjacent cladding elements, caused by relatively minor variations in the thickness of the cladding elements. In some embodiments of the present technology, a concave arcuate bevelled surface is provided rather than a straight chamfer angle. The concave arcuate bevelled surface may be described by at least a tangential angle formed at the interface between the concave arcuate bevelled surface and the front face of the cladding element, and a radius of curvature of the concave arcuate bevelled surface. As will be described in greater detail, the concave arcuate bevelled surface described herein may improve the aesthetic appearance of the cladding elements by retaining the full v-groove thickness of straight chamfered cladding elements, while increasing the tangential angle between the chamfer and the front face of the cladding element, thus reducing the apparent variation in v-groove thickness to a visually imperceptible level. In some embodiments of the present disclosure the concave arcuate bevelled surface can be formed in the front face of the cladding element or alternatively at the edges or sides of the cladding element such that the concave arcuate bevelled surface is positioned at the interface between two adjacent cladding elements as will be described in greater detail below. In a further embodiment, the concave arcuate bevelled surface can be formed in both the front face and at the edges or sides of the cladding element as will also be described in greater detail below.

Referring now to FIG. 1, there is shown a first embodiment of a cladding element 3000, comprising a first surface 3002 and a second surface 3004 spaced apart from the first surface 3002.

Figure 2:
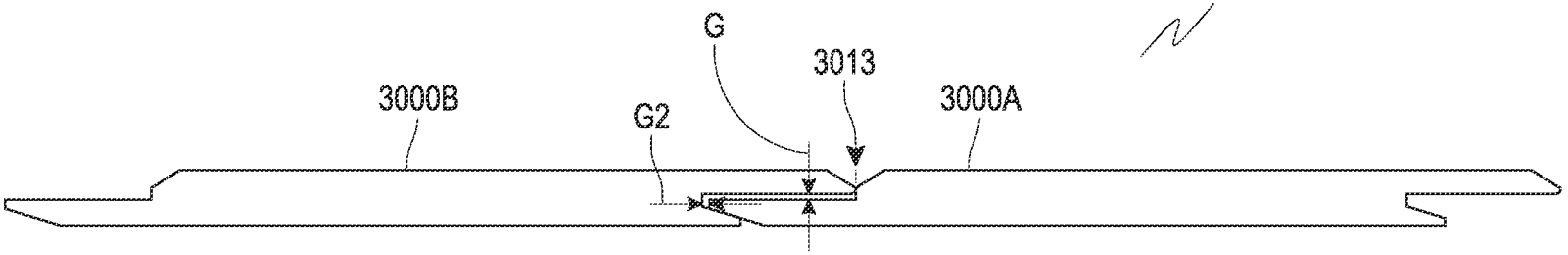
FIG. 2 is a cross-sectional side view of a cladding system having two mated cladding elements of FIG. 1.
Figure 3:
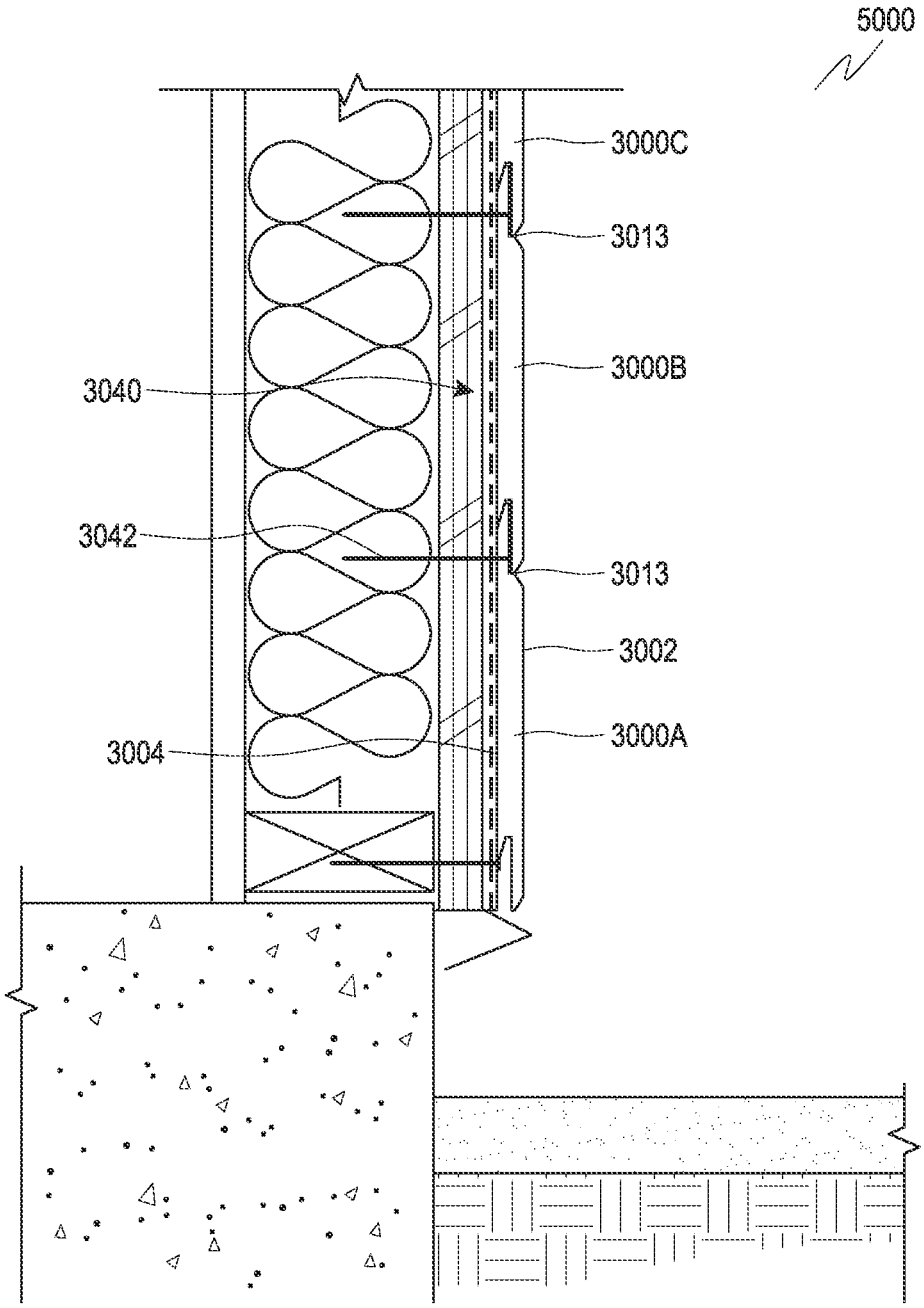
FIG. 3 is a cross-sectional side view of a plurality of cladding elements installed in series on a substrate.

FIGS. 2 and 3 illustrate two embodiments of a cladding system 4000, 5000 respectively comprising two or more cladding elements 3000 in an assembled configuration. For ease of reference cladding elements 3000 in cladding systems 4000 and 5000, have been labelled sequentially as 3000A, 3000B, 3000C and so forth. Cladding system 5000, demonstrates that the first surface 3002 of cladding element 3000 forms an external surface remote from a substructure 3040 when in the assembled configuration and the second surface 3004 of cladding element 3000 forms an internal surface adjacent substructure 3040 when cladding element 3000 is in an assembled configuration.

FIGS. 1, 2 and 3 will be described in greater detail in the following. The first surface 3002 and a second surface 3004 of cladding element 3000 are spaced apart from each other by a defined thickness and bound on each side by opposing side sections. Opposing first and second side sections 3006, 3008 as shown in FIGS. 1, 2 and 3 are contoured. Two further opposing side sections, not shown in the drawings are located substantially perpendicularly to contoured side sections 3006, 3008 such that each of the side sections together form a continuous edge surface around the perimeter of the cladding element 3000 between the first surface 3002 and second surface 3004. In one embodiment, the contoured side sections 3006, 3008 and further opposing side sections located substantially perpendicularly to contoured side sections 3006, 3008 are integrally formed with the first and second surface 3002, 3004 respectively of cladding element 3000. In one embodiment, cladding element 3000 has a thickness of between approximately 7 mm±0.5 mm and approximately 17 mm±0.5 mm. In a further embodiment the cladding element 3000 has a thickness of between approximately 11 mm±0.5 mm and approximately 13 mm±0.5 mm. In a further embodiment the cladding element 3000 has a thickness of approximately 12 mm±0.5 mm. In an alternative embodiment, cladding element 3000 may have a thickness of less than 1 mm or more than approximately 12 mm, such as approximately 13 mm, approximately 15 mm, approximately 16 mm, approximately 17 mm, or more.

In the embodiment shown in FIG. 1, each of the contoured side sections 3006, 3008 facilitate mating of adjacent cladding elements 3000 when assembled in a cladding system 4000, 5000 as shown in FIGS. 2 and 3. Each of contoured side sections 3006, 3008 each comprise first and second flange portions 3032 and 3034 respectively and first and second recessed portions 3036 and 3038 respectively. First flange portion 3032 of first side section 3006 is configured to facilitate location of one or more fasteners (3042 in FIG. 3) to secure a cladding element 3000 to a substructure (3040 in FIG. 3) or wall whilst also facilitating location of second flange portion 3034 such that second contoured side section 3008 mates with first contoured side section 3006.

Turning now to describe the contours of each of first and second contoured side sections or side profiles 3006, 3008 of FIG. 1 in detail.

First and second contoured side sections 3006, 3008 each comprise a bevelled sloping surface 3010, 3012 extending in opposing directions from first surface 3002. A first abutment surface 3014 extends from bevelled sloping surface 3010 whereby first abutment surface 3014 extends substantially perpendicular to both the first surface 3002 and second surface 3004.

A second abutment surface 3016 extends from bevelled sloping surface 3012 whereby second abutment surface 3016 extends substantially perpendicular to both the first surface 3002 and second surface 3004.

First and second substantially planar surfaces 3020 and 3022 extend substantially orthogonally from first and second abutment surfaces 3014 and 3016 respectively whereby the first and second substantially planar surfaces 3020 and 3022 are substantially parallel with first and second surface 3002 and 3004 respectively. The first substantially planar surface 3020 being a front facing surface whilst the second substantially planar surface 3022 being a rear facing surface.

First substantially planar surface 3020 terminates at junction 3024 from which first angled surface 3028 extends to meet second surface 3004. First substantially planar surface 3020, junction 3024, first angled surface 3028 and a portion of second surface 3004 together form first flange portion 3032. First substantially planar surface 3020 forms the nailing surface of flange portion 3032. Flange portion 3032 is recessed with respect to first surface 3002 defining a first recessed portion 3036 between the first substantially planar surface 3020 and first surface 3002.

A portion of first surface 3002, bevelled sloping surface 3012, second abutment surface 3016 extending from bevelled sloping surface 3012 and second substantially planar surface 3022 together form second flange portion 3034 whereby second substantially planar surface 3022 forms the base surface remote from the first surface 3002 of flange portion 3034.

Second contoured side section 3008 further comprises an offset section 3026 which extends substantially orthogonally from second substantially planar surface 3022 thereby forming an open area or second recessed portion 3038 between the second substantially planar surface 3022 and the second surface 3004. A second angled surface 3030 extends from the offset section 3026 to meet the second surface 3004. The area between the second surface 3004 and second angled surface 3030 is referred to as the retention portion 3035.

The first and second contoured sections 3006, 3008 are configured such that when two cladding elements 3000 are seated together the second flange portion 3034 of second contoured section 3008 seats over the first flange portion 3032 of first contoured section 3006 whereby first flange portion 3032 is positioned within the second recessed portion 3038 and the second flange portion 3034 is positioned within the first recessed portion 3036. In such an arrangement, retention portion 3035 of second contoured side section 3008, specifically second angled surface 3030 of retention portion 3035 abuts first angled surface 3028 of first contoured side section 3006. In addition, first abutment surface 3014 of first contoured side section 3006 abuts second abutment surface 3016 of second contoured side section 3008 such that first and second bevelled sloping surfaces 3010, 3012 form a v-groove profile 3013 at the interface between the two cladding elements 3000 as shown in FIG. 2.

Cladding element 3000 may be installed in the form of a cladding system on a building (e.g. an interior or exterior wall), as illustrated in FIG. 3, wherein cladding elements 3000A, 3000B and 3000C are installed in series on substructure 3040 thereby forming an exterior façade surface of a building wall.

In practice, a first cladding element 3000A is installed on substructure 3040 by inserting one or more fasteners 3042 through the first substantially planar surface 3020 of first contoured side section 3006. A second cladding element 3000B is then installed over the first cladding element 3000A whereby the second contoured side section 3008 interlocks with the first contoured side section 3006. One advantage of the cladding elements 3000 when assembling a cladding system such as that shown in FIG. 3, is that an installer may use a level or other tool to confirm the alignment of the first-installed cladding element 3000A but subsequent courses, i.e., the second cladding element 3000B can be installed without the use of an alignment tool, as the mating of first and second contoured side section 3006, 3008 of adjacent cladding elements 3000A and 3000B or 3000B and 3000C align the subsequent cladding elements with the first-installed cladding element 3000.

As shown in FIG. 2, a gap G is provided between first substantially planar surface 3020 of first contoured side section 3006 and second substantially planar surface 3022 of second contoured side section 3008 when the first and second cladding elements 3000A and 3000B are seated together. The gap G can be between 0.254 mm (0.01 inches) and 2.54 mm (0.1 inches) when measured perpendicular to the first substantially planar surface 3020 and second substantially planar surface 3022. In some embodiments, the gap G is approximately 1.524 mm (0.06 inches) when measured perpendicular to the first substantially planar surface 3020 and second substantially planar surface 3022.

A second gap G2 is also formed between the offset section 3026 of second contoured side section 3008 and junction 3014 first contoured side section 3006. The second gap G2 can be connected to and/or continuous with the gap G.

The fasteners 3042 are hidden from view within the gap G by the second flange portion 3034 of the second cladding element 3000B when second cladding element 3000B interlocks with the first cladding element 3000A. Utilizing such a fastening process (e.g., "blind" nailing) can improve the aesthetics of an assembled cladding system comprising cladding elements 3000. In some cases, blind nailing can increase the durability of the assembled cladding elements 3000 by, for example, reducing exposure of the fasteners and their respective holes to moisture and other outside elements. In some applications, blind nailing can reduce the costs of installing the cladding elements 3000 on a wall by reducing the number of fasteners required to install the cladding elements 3000 and thereby reducing the amount of time required to install the cladding elements 3000. In addition, the geometry of the cladding element 3000 enables an end user to construct a cladding system 5000 as shown in FIG. 3, utilizing the above described blind nailing process and achieve a satisfactory wind load requirement when the cladding element 3000 has a thickness of 12 mm±1 mm without the use of a clip mechanism.

The gaps G and/or G2 can be sized and/or shaped to accommodate adhesives, sealants, insulators, and/or other materials.

Positioning materials in the gap G between first substantially planar surface 3020 of first contoured side section 3006 and second substantially planar surface 3022 of second contoured side section 3008 can increase the weather resistance of the assembled cladding elements 3000 by reducing the likelihood that moisture (e.g., rain, condensation, etc.) will enter pass between adjacent cladding elements 3000. In some embodiments, sealant or other materials can also be inserted into the second gap G2 in addition to or instead of sealant or other materials into gap G.

The configuration of the first and second contoured side sections 3006, 3008 provide an interlocking mechanism for the cladding elements 3000 of the cladding system 4000, 5000 that increases wind load performance particularly in the instance when the thickness is between approximately 11 mm±0.5 mm and approximately 13 mm±0.5 mm and more particularly at approximately 12 mm±0.5 mm.

A plurality of cladding elements 3000 wherein thickness was approximately 12 mm±0.5 mm were arranged to form a cladding system which was tested for wind loading capabilities using a standard test method (ASTM E330-02 (2010)) for structural performance of exterior cladding. The frame spacing used was 23"-⅝" using a 4D ring shank fastener. The average wind load achieved for cladding elements 3000 was 83.75 psf (4.01 KPa).

Figure 4:
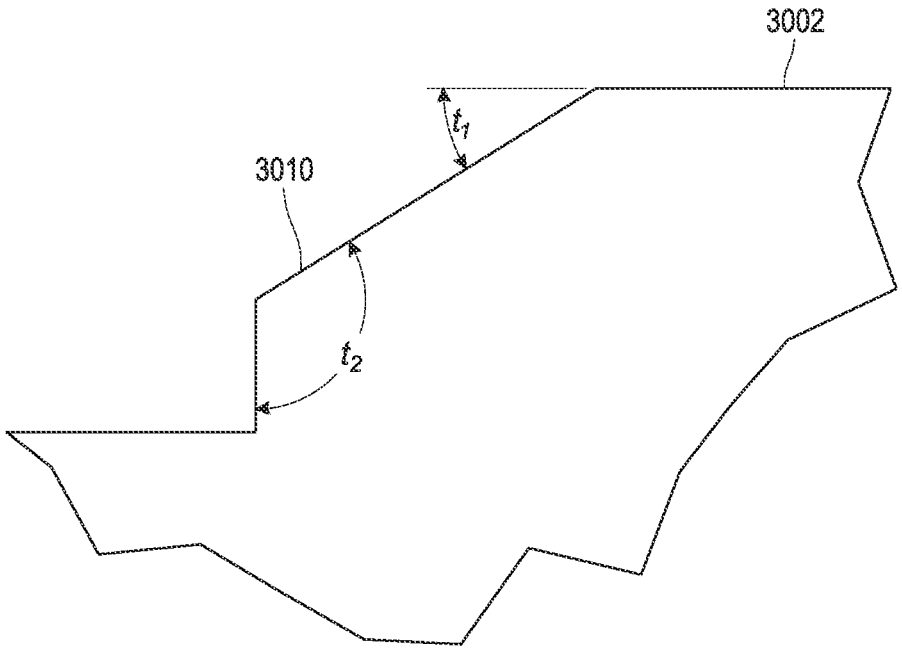
FIG. 4 is an enlarged cross-sectional side view of the bevel area of one embodiment of a cladding element.

Referring now specifically to FIGS. 1 and 4, each of bevelled sloping surfaces 3010, 3012 extend at an angle from the first surface 3002 hereinafter referred to as the tangential angle t1, whereby Tan t1 is defined as being the length of the opposite side divided by the length of the adjacent side. In each of the contoured side section 3006, the opposite side is defined as being the distance between first surface 3002 and a corresponding co-planar axis parallel to first surface 3002 extending from the end of the bevelled sloping surfaces 3010 remote the first surface 3002. The adjacent side is defined as being the distance between the two parallel co-planar axes extending from each end of the bevelled sloping surfaces 3010 perpendicular to the first surface 3002. In one embodiment the tangential angle t1 is between approximately 32° and approximately 47.5°±2°.

In a similar way, the angle at the junction between the end of the bevelled sloping surface 3010 opposite the first surface 3002 and first abutment surface 3014 (FIG. 1), angle t2 is between approximately 122° and approximately 131°±1°. In a further embodiment, angle t2 is approximately 122°±1°.

Figure 5:
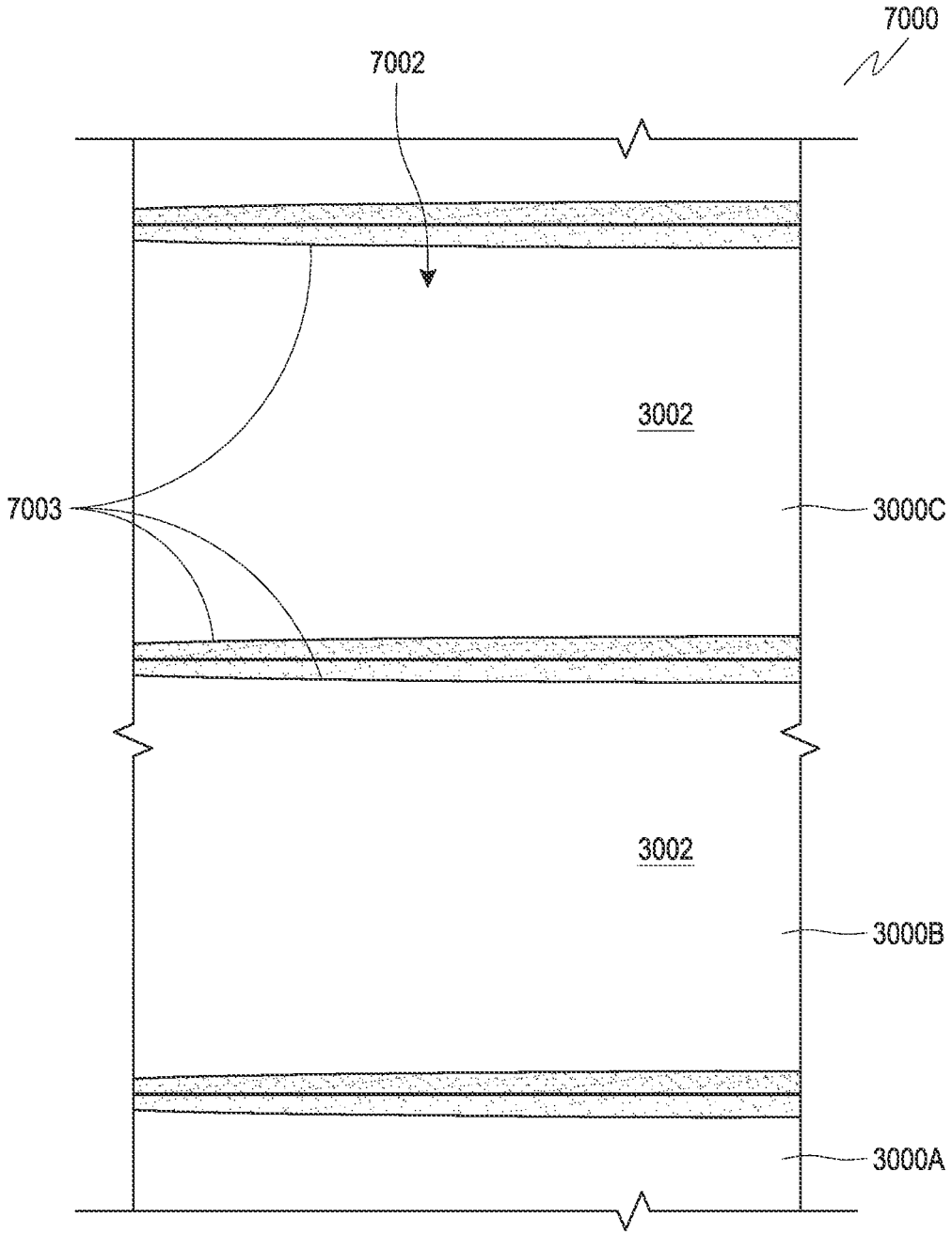
FIG. 5 is a front elevation view of a series of cladding elements of FIG. 4.

Turning now to FIG. 5, there is shown a section of a cladding system 7000 comprising a plurality of cladding elements 3000, the first surface 3002 of each cladding element 3000 forms the exterior front surface 7002 of the cladding system 7000. In this particular embodiment, cladding element 3000 has a thickness of approximately 12 mm±0.5 mm, accordingly the tangential angle t1 of the first and second bevelled sloping surface 3012, 3014 is approximately 32°±1°. Surprisingly, a perceptible visual variation was seen at the interface between two adjacent cladding elements 3000 in the instance when the tangential angle t1 of the first and second bevelled sloping surface 3012, 3014 was approximately 32°±1° was viewed by an end user. The perceptible variation was seen as wavy line 7003 by end users. As it is desirable in one embodiment to provide a cladding element with a thickness of approximately 12 mm±0.5 mm wherein, each cladding element is contoured to achieve interlocking which delivers acceptable wind load requirements without the use of a clip mechanism it was preferable to provide a solution that did not have a perceptible visual variation.

Figure 6:
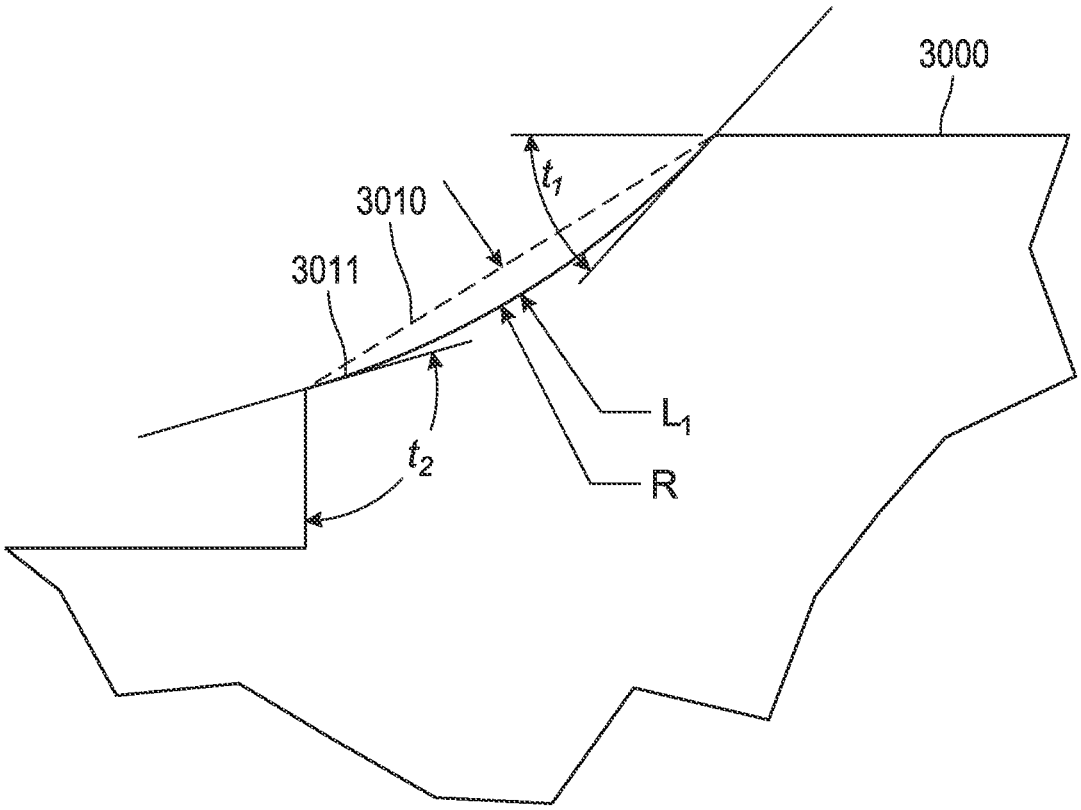
FIG. 6 is an enlarged cross-sectional side view of a second bevel area of one embodiment of a cladding element.
Figure 9A:
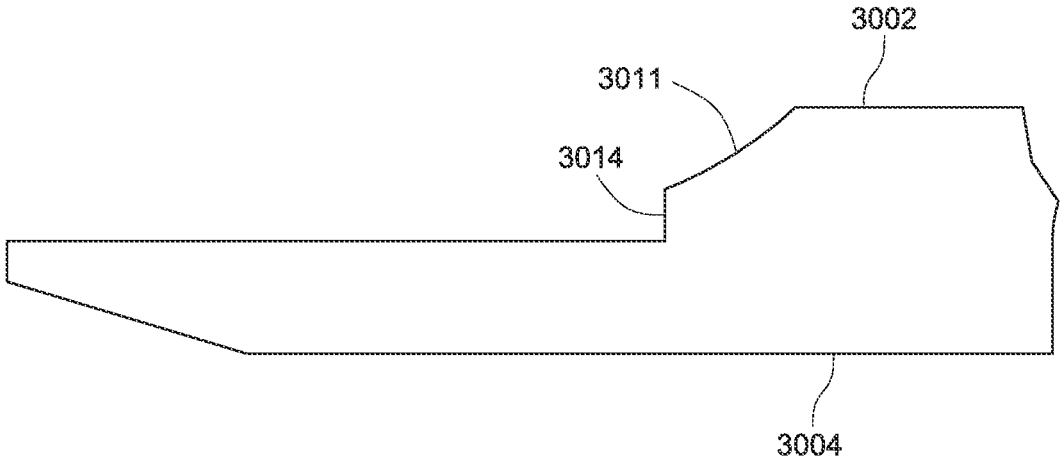
FIGS. 9A to 9F illustrate cross-sectional side views of further embodiments of the bevel area of a cladding element.
Figure 9B:
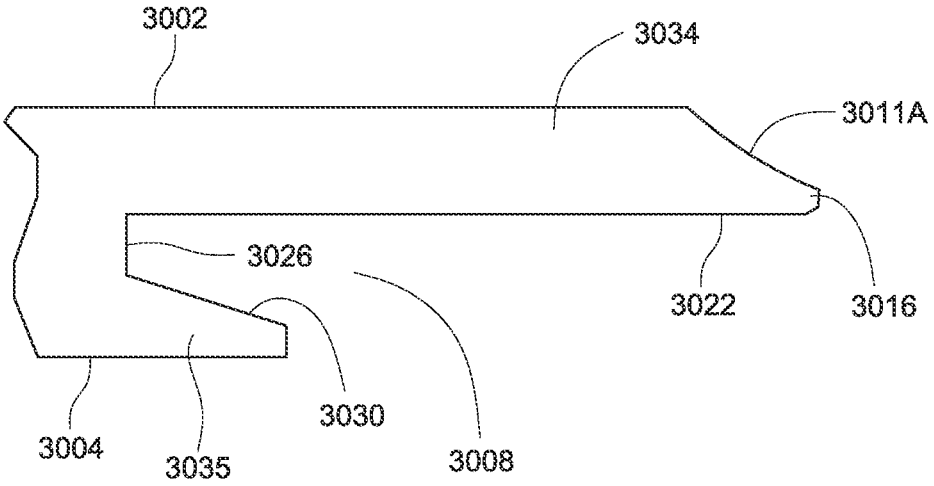
Figure 9C:
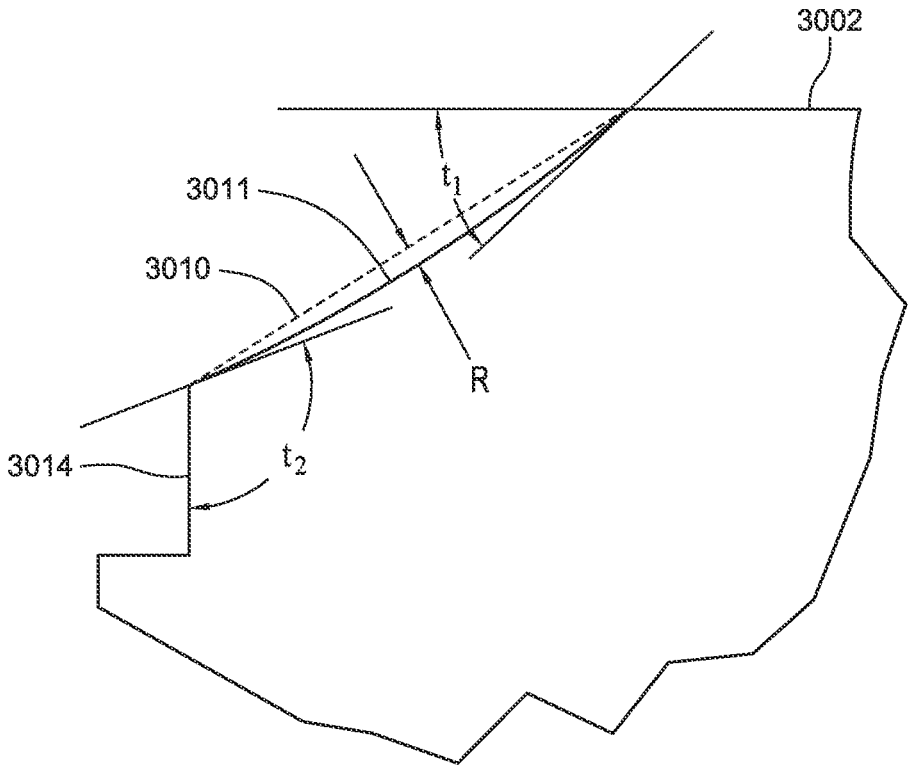
Figure 9D:
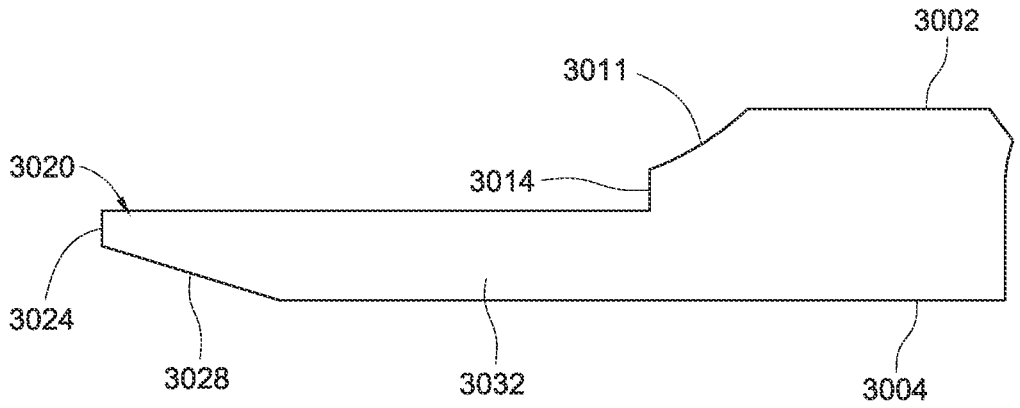
Figure 9E:
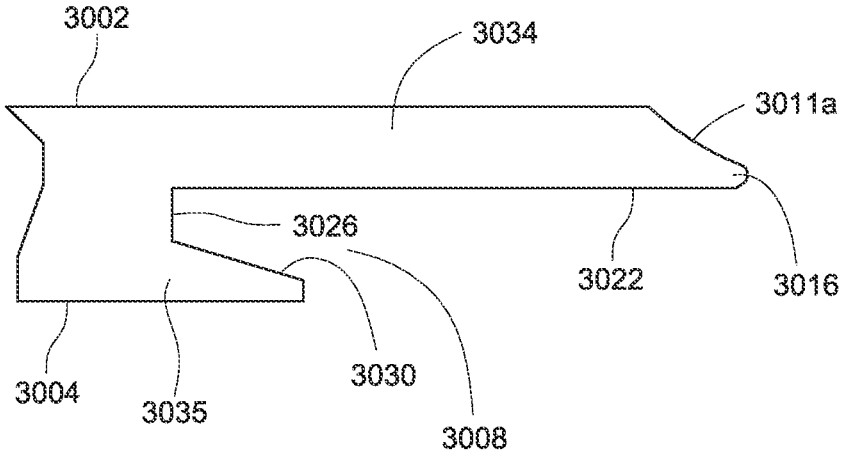
Figure 9F:
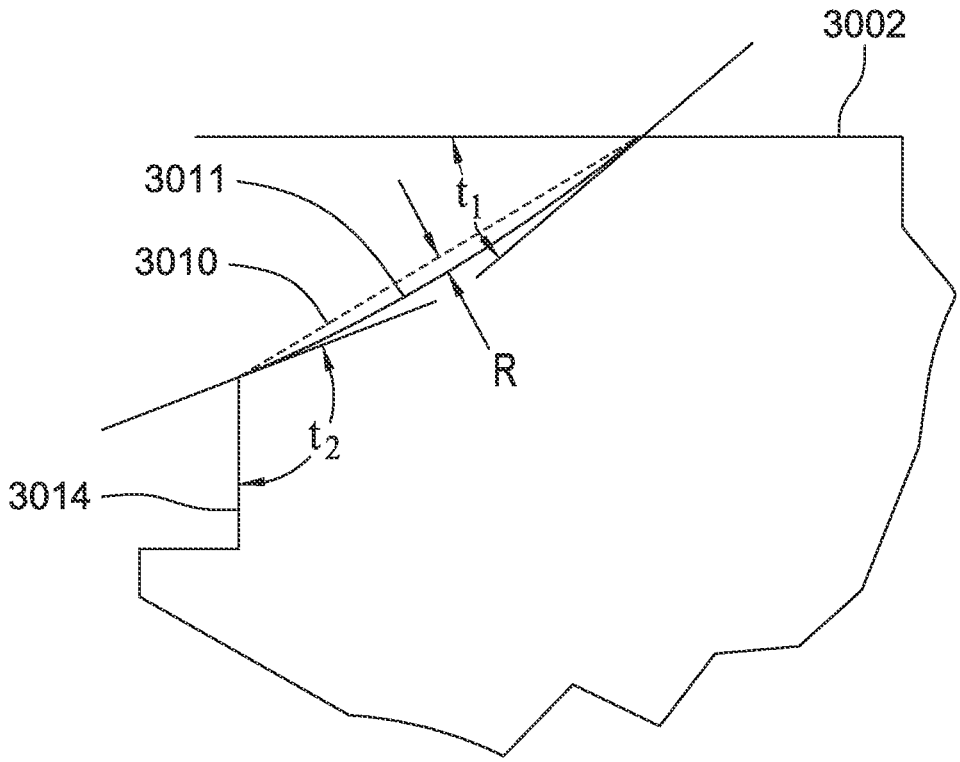

Turning now to FIG. 6, there is shown a bevelled sloping surface 3010 (shown in dotted line) of cladding element 3000 together with a concave arcuate bevelled surface 3011 wherein a slight curvature has been introduced to the bevelled sloping surface 3010 thereby forming concave arcuate bevelled surface 3011 having a radius of curvature R. In the embodiment shown, the distance between the bevelled sloping surface 3010 and the concave bevelled surface 3011 is defined as L1. The effect of reducing the position of the bevelled sloping surface 3010 by a distance L1 through the introduction of a slight curvature to the bevelled sloping surface 3010 is that the tangential angle t1 effectively increases and the perceptible variation seen by end users is removed. In one embodiment, the distance L1 between the bevelled sloping surface 3010 and the concave arcuate bevelled surface 3011 ranges between 0.1 mm and 0.8 mm.

FIGS. 7A-7G show a series of bevelled sloping surface 3010 (shown in dotted line) of cladding element 3000 wherein the radius of curvature introduced has been varied creating an array of concave bevelled surfaces 3011.

The tangential angles t1 shown in FIGS. 7A-7G are merely illustrative examples, and it will be understood that any intermediate value of angle t1 between those explicitly illustrated in FIGS. 7A-7G may equally be incorporated. FIG. 7A illustrates an example tangential angle of t1=35°. FIG. 7B illustrates an example tangential angle of t1=40°. FIG. 7C illustrates an example tangential angle of t1=41°. FIG. 7D illustrates an example tangential angle of t1=45°. FIG. 7E illustrates an example tangential angle of t1=47.5°. FIG. 7F illustrates an example tangential angle of t1=50°. FIG. 7G illustrates an example tangential angle of t1=55°. FIGS. 8A-8G show the series of concave bevelled surfaces 3011 as applied to each of the first and second bevelled sloping surface 3010, 3012 at the interface between two adjacent cladding elements 3000. It can be seen that the interface angle θ increases as the tangential angle t1 increases.

Table 1, below, summarizes the selection of radius of curvature r, corresponding distances L1 and tangential angle t1 by which the bevelled sloping surface 3010 can be adjusted through the introduction of a concave bevelled surface 3011 as shown in FIGS. 7A-7G and the interface angle θ as shown in FIGS. 8A-8G.

TABLE 1

Relationship between radius of curvature and distance L1, tangential angle t1, and interface angle θ.

| Radius of Curvature r/mm | Distances $L_1$/mm | Tangential Angle t1/° | Interface Angle θ/° |
|---|---|---|---|
| 67.61 | 0.10 | 35 | 123 |
| 26.30 | 0.27 | 40 | 133 |
| 22.60 | 0.31 | 41 | 135 |
| 16.40 | 0.43 | 45 | 143 |
| 13.84 | 0.51 | 47.5 | 148 |
| 11.98 | 0.60 | 50 | 153 |
| 9.50 | 0.77 | 55 | 163 |

It was determined that by increasing the radius of curvature of the concave bevelled surface 3011, it is possible to remove the visual variation whilst retaining a sloped 'v-groove' aesthetic at the interface between two adjacent cladding elements 3000. However, if the radius of curvature is increased too much, then the 'v-groove' aesthetic at the interface between two adjacent cladding elements 3000 becomes an arc-like aesthetic which is less desirable. Accordingly, in one embodiment, it is preferable to adjust the bevelled sloping surface 3010 by a distance L1 to achieve a preferred tangential angle t1. In one embodiment, the distance L1 is between 0.27 and 0.51 mm and the preferred tangential angle t1 is between approximately 40° and approximately 47.5°±1°.

Further example embodiments are illustrated in FIGS. 9A to 9F. As shown in FIG. 9, example tangential angles t1 may be, for example, approximately 41.6°, approximately 39.6°, or other suitable angles within the various ranges of tangential angles disclosed herein. In one example embodiment, such as in the examples illustrated in FIGS. 9A to 9F, a cladding element may have a tangential angle t1 of approximately 39.6° combined with a reduced thickness of approximately 11.1 mm, and a corresponding radius of curvature of 22.60 mm at the bevelled portion.

Figure 10A:
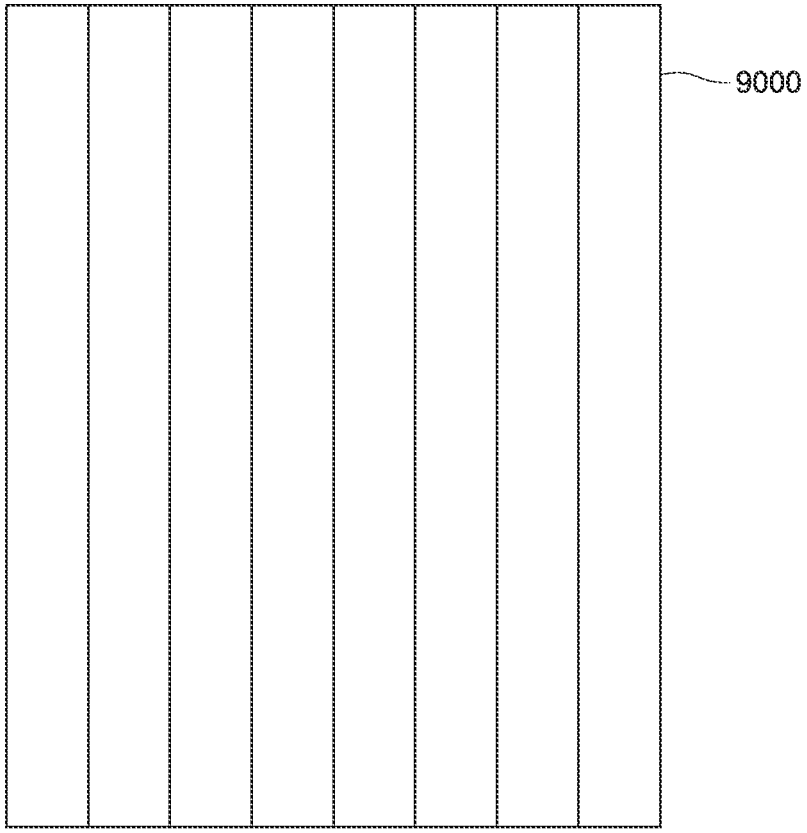
FIGS. 10A and 10B are a front elevation view and a perspective view respectively of a further embodiment of a cladding element.
Figure 10B:
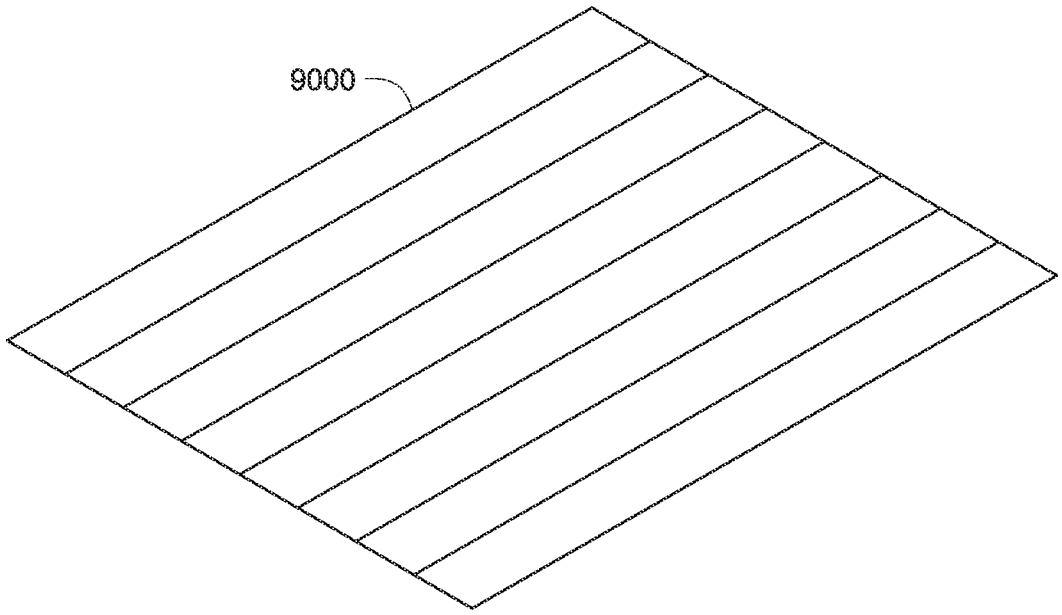
Figure 10C:
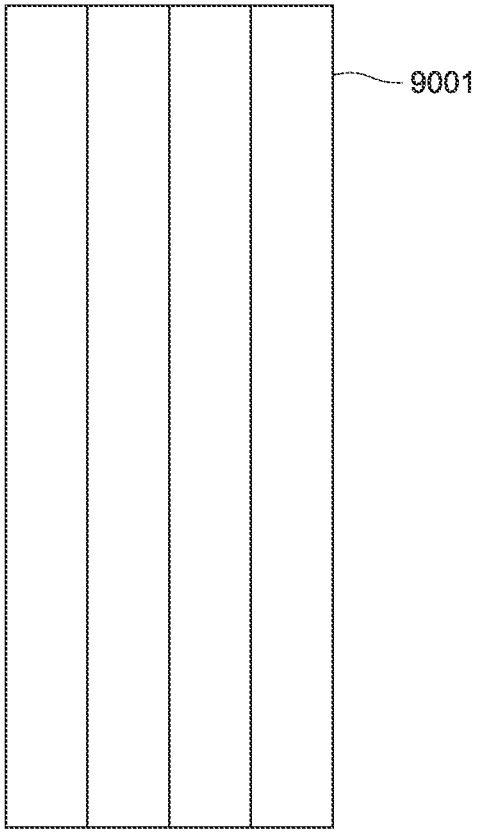
FIGS. 10C and 10D are front elevation and perspective views respectively of a yet further embodiment of a cladding element.
Figure 10D:
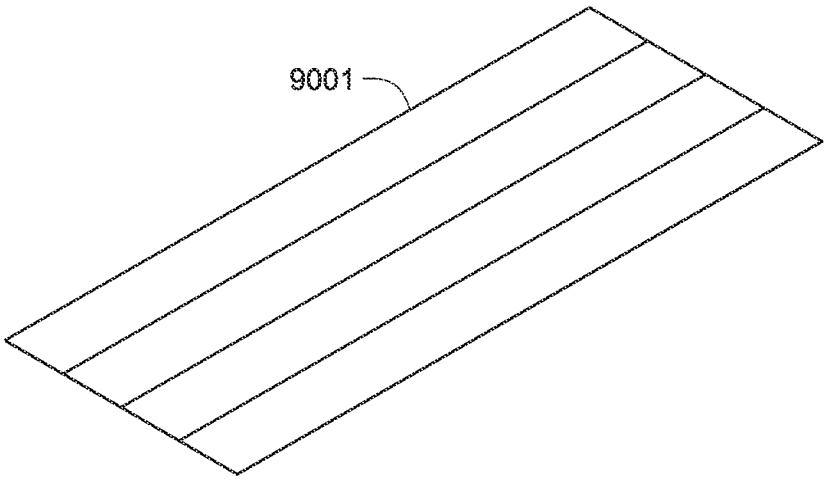
Figure 10E:
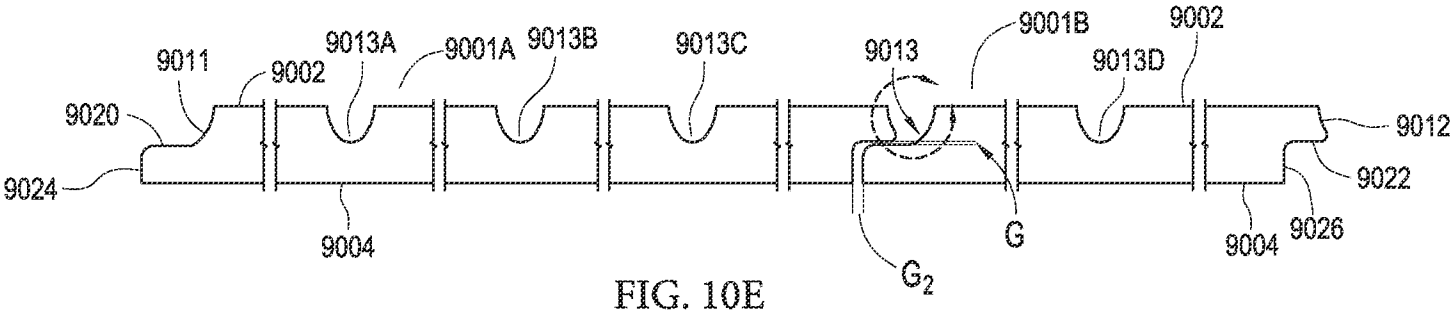
FIG. 10E is a cross sectional side view of a cladding system having two mated cladding element of FIGS. 10A and 10B respectively.
Figure 10F:
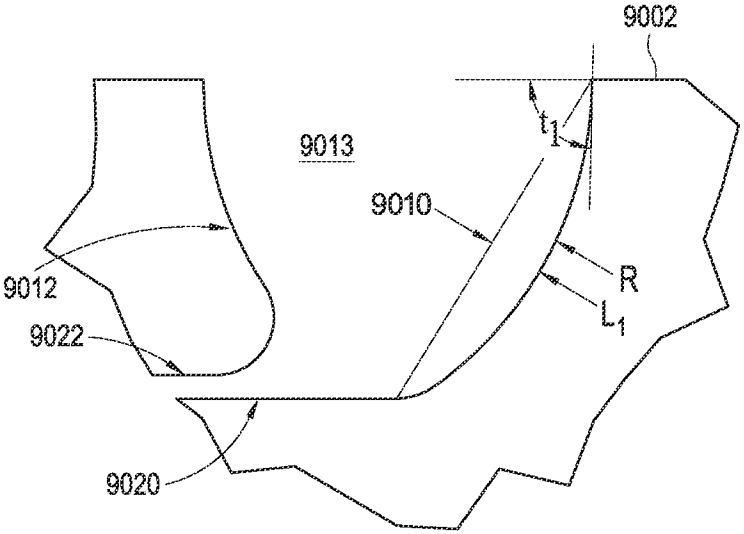
FIG. 10F is an enlarged cross-sectional side view of the bevel area of the cladding elements of FIGS. 10A and 10B at the section where two cladding elements are in an abutment arrangement.
Figure 10G:
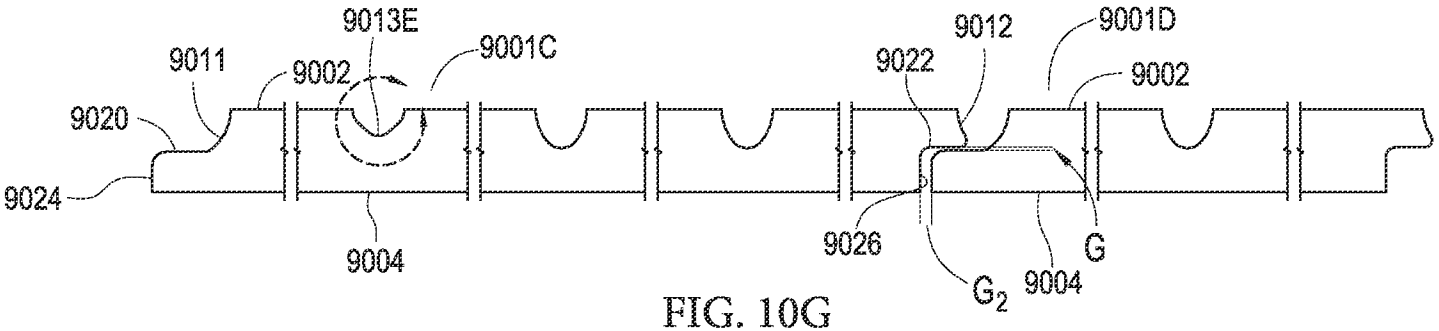
FIG. 10G is a cross sectional side view of a cladding system having two mated cladding element of FIGS. 10C and 10D respectively.

Further example embodiments are illustrated in FIGS. 10A to 10H, which will be described in greater detail in the following. FIGS. 10A to 10D show two further embodiments of a cladding element 9000 and 9001, wherein a plurality of chamfered profiles 9013 for example, v-groove profiles are spaced apart from each other in the front surface 9002 of the cladding elements 9000 and 9001. For ease of reference, the chamfered profiles or v-groove profiles 9013 in cladding elements 9000 and 9001 have been labelled sequentially as 9013A, 9013B, 9013C and so forth as shown in FIGS. 10E and 10G. In the embodiment shown, v-groove profiles 9013A, 9013B, 9013C and so forth are spaced apart from each other by approximately 30.4 cm (12") on centre. However, such profiles can also be spaced apart by lesser or greater distances as desired by an end user. In some instances, the one or more v-groove profiles can be spaced apart by distances ranging between approximately 2.54 cm (1") or less and 60.9 cm (24") or greater as determined by the end user and/or the size of the cladding element.

Additionally, the cladding element 9000 and 9001 are also provided with first and second contoured side profiles to facilitate assembly of a cladding system. Cladding systems 9000 and 9001 each comprise a front face 9002; a rear face 9004 opposite the front face; opposing first and second contoured side profile between the front face and the rear face. The first surface 9002 and a second surface 9004 of cladding elements 9000, 9001 are spaced apart from each other by a defined thickness and bound on each side by opposing contoured side profiles. As can be seen in FIGS. 10A to 10D, two further opposing side sections, are located substantially perpendicularly to contoured side sections such that each of the side sections together form a continuous edge surface around the perimeter of the cladding elements 9000, 9001 between the first surface 9002 and second surface 9004. In one embodiment, the contoured side sections and further opposing side sections located substantially perpendicularly to contoured side sections are integrally formed with the first and second surface 9002, 9004 respectively of cladding elements 9000, 9001. In one embodiment, cladding elements 9000, 9001 have a thickness of between approximately 7 mm±0.5 mm and approximately 17 mm±0.5 mm. In a further embodiment the cladding element 9000, 9001 has a thickness of between approximately 7 mm±0.5 mm and approximately 13 mm±0.5 mm. In a further embodiment the cladding element 3000 has a thickness of approximately 8 mm±0.5 mm. Cladding element 9000 may have a thickness of less than 1 mm or more than approximately 12 mm, such as approximately 13 mm, approximately 15 mm, approximately 16 mm, approximately 17 mm, or more.

The contoured side profiles comprising first and second concave arcuate bevelled surfaces 9011 and 9012 extending from the front face of the cladding element in opposing directions. Each of first and second contoured side profiles further comprise first and second substantially planar surfaces 9020 and 9022 respectively. Concave arcuate bevelled surfaces 9011 and 9012 extend in opposing directions from front face 9002 towards first and second substantially planar surfaces 9020 and 9022, wherein first substantially planar surface 9020 is a front-facing surface set rearward from the front surface 9002 of the cladding element. First joint end 9024 connects first substantially planar surface 9020 to the rear face 9004 of the cladding element. Similarly, second substantially planar surfaces 9022 is a rear-facing surface set frontward from the rear surface 9004 of the cladding element. Second joint end 9026 connects second substantially planar surface 9022 to the rear face 9004 of the cladding element FIGS. 10E and 10G illustrate two embodiments of cladding system comprising two or more cladding elements 9000 and 9001 respectively in an assembled configuration wherein the interface between the two adjacent cladding elements comprise a bevelled or chamfered edge. For ease of reference cladding elements 9000/9001 have been labelled sequentially as 9001A, 9001B, 9001C and so forth. Each of the contoured side sections or profiles facilitate mating of adjacent cladding elements 9001A, 9001B and 9001C and 9001D when assembled in a cladding system as shown in FIGS. 10E and 10F. In a similar manner to that previously described, the first and second contoured sections are configured such that when two cladding elements 9001A and 9001B are seated together the second substantially planar surface 9022 seats over the first substantially planar surface 9020 such that the two cladding elements are overlapping. In addition, first joint end 9024 abuts or is seated in very close proximity to second joint end 9026 of second contoured side section such that first and second bevelled sloping surfaces 9011, 9012 form a v-groove profile 9013 at the interface between the two cladding elements 9000, 9001.

The contoured side sections seat together in an overlapping configuration leaving Gaps G and G2 to facilitate location of fasteners. The first substantially planar surface 9020 is configured to facilitate location of one or more fasteners to secure cladding elements 9000 and 9001 to a substructure (or wall) in a similar manner to that previously described.

Turning now to FIG. 10F, there is shown a bevelled sloping surface 9010 of cladding element 9001B together with a concave arcuate bevelled surface 9011 (FIG. 10E) wherein a slight curvature has been introduced to the bevelled sloping surface 9010 thereby forming concave arcuate bevelled surface 9011 having a radius of curvature R. In the embodiment shown, the distance between the bevelled sloping surface 9010 and the concave bevelled surface 9011 is defined as L1. As before, the effect of reducing the position of the bevelled sloping surface 9010 by a distance L1 through the introduction of a slight curvature to the bevelled sloping surface 9010 is that the tangential angle t1 effectively increases and the perceptible variation seen by end users is removed. In one embodiment, the distance L1 between the bevelled sloping surface 9010 and the concave arcuate bevelled surface 9011 ranges between 0.1 mm and 0.8 mm.

Figure 10H:
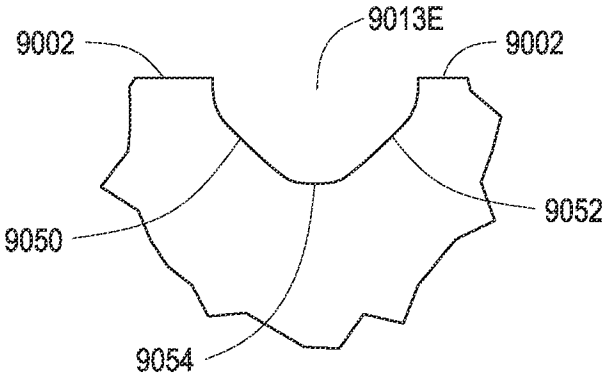
FIG. 10H is an enlarged cross-sectional side view of the bevel area 9013A of the cladding elements of FIG. 10G.

In another embodiment as shown in FIG. 10H, a tapered v-groove profile 9013E is provided whereby the v-groove profile comprises first and second concave arcuate bevelled surface 9050 and 9052 respectively and a base member 9054 intermediate the first and second concave arcuate bevelled surface 9050 and 9052 such that a truncated v-groove profile is formed in the front face of the cladding element.

In any of the various embodiments illustrated herein, for example in the embodiments of FIGS. 6-10H, a variety of fastening or mounting means may be used as described herein. For example, in some embodiments any of the cladding articles disclosed herein may be fastened or mounted by one or more nails, screws, or other fasteners extending through the nailing surfaces 3020, 9020 or other portions of the cladding articles, so as to achieve desirable wind load characteristics. For example, in some embodiments, suitable nails or screws may allow the mounted cladding articles to withstand a wind load of for example, 14.5 in-$H_2O$ (3.61 KPa).

In one preferred embodiment, each of cladding elements 3000, 9000, 9001 are a fibre cement cladding element, comprising a hydraulic binder such as Portland cement, a silica source and fibres including cellulose fibres. It should be understood that other suitable materials known to a person skilled in the art, can also be included in the formulation. In one embodiment, the fibre cement cladding element is a medium density cladding element. In an alternative embodiment, the fibre cement cladding element is a low-density cladding element. In one particular embodiment, the density of the fibre cement cladding element is approximately 1.28 g/cm$^3$. Each of the cladding elements of the present disclosure comprising a concave arcuate bevelled surface can be in the form of a plank, panel or shingle and so forth cladding elements.

In one embodiment, each of cladding elements 3000, 9000, 9001 are provided with a either a smooth or a textured surface such as a wood effect texture or a render effect texture. Other suitable textures can also be provided as desired by an end-user, for example, brick or stone effect textures. For example, in some instances the first surface 3002, 9002 is provided with a smooth or textured surface. In other examples, both the first surface 3002, 9002 and the second surface 3004, 9004 are provided with a smooth or textured surface.

Cladding elements may be installed in cladding systems in conjunction with flashing strips, caulk, and/or other weatherproofing materials to reduce moisture transfer to the structure on which the cladding elements are installed. In some cases, it may be advantageous to provide weatherproofing structure on the cladding elements themselves to reduce or eliminate the need for additional weatherproofing materials and/or waterproofing installation steps. For example, the cladding elements may include one or more joint features configured to facilitate drainage of moisture from the assembled/installed cladding elements away from the structure on which the cladding elements are installed. The joint features can be configured to facilitate moisture drainage from the cladding elements as the cladding elements shrink and/or expand after installation (e.g., due to temperature change, evaporation, chemical processes, etc.). In some embodiments, the joint features create a tortuous and/or labyrinthine passage between a front side of the cladding elements and a back side of the elements, thereby reducing the amount of moisture passage between the front side of the cladding elements and the back side of the cladding elements when the cladding elements are installed on a wall or other structure. In some cases, cladding elements which include joint features are capable of being installed both vertically (e.g., having joint features on top and bottom sides of the cladding elements) and horizontally (e.g., having joint features on lateral sides of the cladding elements), depending on the application. Examples of such joint features are described below.

In further embodiments, the two further opposing side sections, not shown in the drawings which are located substantially perpendicularly to contoured side sections 3006, 3008 can also include features to enhance coupling with adjacent cladding elements located substantially perpendicular to contoured side sections 3006, 3008. Such features could include for example one or more of corresponding angled side surface or tongue and groove joints or stepped joints. In addition sealing elements such as for example caulk or other sealing materials can also be used to reduce moisture passage through the cladding system.

Although the embodiments have been described with reference to specific examples, it will be appreciated by those skilled in the art that the disclosure may be embodied in many other forms.

It is also contemplated that various combinations or sub-combinations of the specific features and aspects of the embodiments may be made and still fall within the scope of the disclosure. Accordingly, it should be understood that various features and aspects of the disclosed embodiments can be combined with or substituted for one another in order to form varying modes of the disclosed embodiment. Thus, it is intended that the scope of the present disclosure herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

It will of course be understood that the invention is not limited to the specific details described herein, which are given by way of example only, and that various modifications and alterations are possible within the scope of the disclosure as defined in the appended claims.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as 'can', 'could', 'might', or 'may', unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase 'at least one of X, Y, and Z' unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y, and at least one of Z.

Language of degree used herein, such as the terms 'approximately', 'about', 'generally' and 'substantially' as used herein represent a value, amount, or characteristic close to the stated value, amount or characteristic that still performs a desired function or achieves a desired result. For example, the terms 'approximately', 'about', 'generally' and 'substantially' may refer to an amount that is within less than or equal to 10% of, within less than or equal to 5% of, within less than or equal to 1% of, within less than or equal to 0.1% of, and within less than or equal to 0.01% of the stated amount.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with chamfered or bevelled profiles on cladding elements and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practised using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A cladding element comprising:

a front face;

a rear face opposite the front face;

opposing first and second contoured side profiles between the front face and the rear face, the first contoured side profile comprising:

a first recessed portion having a front-facing surface set rearward from the front surface of the cladding element;

a first chamfer portion extending from the rear face of the cladding element toward the front face of the cladding element and away from a second contoured side profile of the cladding element;

a first concave arcuate bevelled surface extending from the front face of the cladding element toward the first recessed portion and away from the second contoured side profile; and a first abutment face connecting the front-facing surface of the first recessed portion with the first concave arcuate bevelled surface;

the second contoured side profile between the front face and the rear face, opposite the first contoured side profile, the second contoured side profile comprising:

a second recessed portion having a rear-facing surface set forward from the rear face of the cladding element;

a second chamfer portion extending in a direction from the rear face of the cladding element toward the front face of the cladding element and toward the first contoured side profile;

a second concave arcuate bevelled surface extending from the front face of the cladding element toward the recessed portion and away from the first contoured side profile; and a second abutment face connecting the rear-facing surface of the recessed portion with the concave arcuate bevelled surface;

a first joint end between the front face and the rear face; and a second joint end between the front face and the rear face, opposite the first joint end.

2. The cladding element of claim 1, wherein the first concave arcuate bevelled surface intersects the front face at a first angle t1 relative to the front face and intersects the first abutment face at a second angle smaller than t1 relative to a plane parallel to the front face.

3. The cladding element of claim 2, wherein the first angle t1 is between approximately 32° and approximately 47.5°.

4. The cladding element of claim 2, wherein the first angle t1 is between approximately 40° and approximately 47.5°.

5. The cladding element of claim 2, wherein the first angle t1 is between approximately 38° and approximately 42°.

6. The cladding element of claim 2, wherein the first angle t1 is approximately 39.6°.

7. The cladding element of claim 2, wherein the first concave arcuate bevelled surface has a radius of curvature between approximately 67.61 mm and approximately 13.84 mm.

8. The cladding element of claim 2, wherein the first concave arcuate bevelled surface has a radius of curvature between approximately 26.30 mm and approximately 13.84 mm.

9. The cladding element of claim 1, wherein the first concave arcuate bevelled surface and the second concave arcuate bevelled surface intersect the front face at approximately the same tangential angle.

10. The cladding element of claim 1, wherein the first concave arcuate bevelled surface and the second concave arcuate bevelled surface have approximately the same radius of curvature.

11. The cladding element of claim 10, wherein the first and second cladding elements comprise fibre cement.

12. A cladding system comprising a plurality of cladding elements, the system comprising:

first and second cladding elements, each of the first and second cladding elements having:

a front face;

a rear face opposite the front face;

opposing first and second contoured side profile between the front face and the rear face;

the first contoured side profile comprising:

a first recessed portion having a front-facing surface set rearward from the front surface of the cladding element;

a first chamfer portion extending from the rear face of the cladding element toward the front face of the cladding element and away from a second contoured side profile of the cladding element;

a first concave arcuate bevelled surface extending from the front face of the cladding element toward the first recessed portion and away from the second contoured side profile; and a first abutment face connecting the front-facing surface of the first recessed portion with the first concave arcuate bevelled surface;

the second contoured side profile between the front face and the rear face, opposite the first contoured side profile, the second contoured side profile comprising:

a second recessed portion having a rear-facing surface set forward from the rear face of the cladding element;

a second chamfer portion extending in a direction from the rear face of the cladding element toward the front face of the cladding element and toward the first contoured side profile;

a second concave arcuate bevelled surface extending from the front face of the cladding element toward the recessed portion and away from the first contoured side profile; and a second abutment face connecting the rear-facing surface of the recessed portion with the concave arcuate bevelled surface;

a first joint end between the front face and the rear face; and a second joint end between the front face and the rear face, opposite the first joint end;

wherein:

the first contoured side profile of the first cladding element is mated with the second contoured side profile of the second cladding element;

at least a portion of the first chamfer portion of the first cladding element contacts at least a portion of the second chamfer portion of the second cladding element; and the first concave arcuate bevelled surface of the first cladding element is positioned adjacent the second concave arcuate bevelled surface of the second cladding element to form an arcuate v-groove profile.

13. The system of claim 12, wherein the first concave arcuate bevelled surface intersects the front face at a first angle t1 relative to the front face and intersects the first abutment face at a second angle smaller than t1 relative to a plane parallel to the front face.

14. The system of claim 13, wherein the first angle t1 is between approximately 32° and approximately 47.5°.

15. The system of claim 13, wherein the first angle t1 is between approximately 40° and approximately 47.5°.

16. The system of claim 13, wherein the first angle t1 is between approximately 38° and approximately 42°.

17. The system of claim 13, wherein the first angle t1 is approximately 39.6°.

18. The system of claim 12, wherein the first concave arcuate bevelled surface has a radius of curvature between approximately 67.61 mm and approximately 13.84 mm.

19. The system of claim 12 wherein the first concave arcuate bevelled surface has a radius of curvature between approximately 26.30 mm and approximately 13.84 mm.

20. The system of claim 12, wherein the first concave arcuate bevelled surface and the second concave arcuate bevelled surface intersect the front face at approximately the same tangential angle.

21. The system of claim 12, wherein the first concave arcuate bevelled surface and the second concave arcuate bevelled surface have approximately the same radius of curvature.

22. The system of claim 12, wherein the first and second cladding elements have a thickness of between approximately 11 mm and approximately 17 mm.

23. The system of claim 12, wherein the arcuate v-groove profile extends along an entire length of each of the first and second cladding elements with no visibly perceptible variations in a width of the v-groove profile.

24. The system of claim 12, wherein the first and second cladding elements comprise fibre cement.

* * * * *